US010077173B2

(12) United States Patent
Shan et al.

(10) Patent No.: US 10,077,173 B2
(45) Date of Patent: Sep. 18, 2018

(54) SINGLE-CYLINDER PLUG PIN TYPE TELESCOPIC ARM, TELESCOPIC METHOD THEREOF AND CRANE HAVING TELESCOPIC ARM

(71) Applicant: XUZHOU HEAVY MACHINERY CO., LTD., Xuzhou (CN)

(72) Inventors: Zenghai Shan, Xuzhou (CN); Quan Dong, Xuzhou (CN); Yongjian Deng, Xuzhou (CN); Xin Zhang, Xuzhou (CN); Mengbing Zhu, Xuzhou (CN); Xiaohui Wang, Xuzhou (CN); Chenglin Xiao, Xuzhou (CN); Yuchun Zhao, Xuzhou (CN)

(73) Assignee: XUZHOU HEAVY MACHINERY CO., LTD., Xuzhou (CN)

( * ) Notice: Subject to any disclaimer, the term of this patent is extended or adjusted under 35 U.S.C. 154(b) by 264 days.

(21) Appl. No.: 14/914,643

(22) PCT Filed: Aug. 27, 2014

(86) PCT No.: PCT/CN2014/085298
§ 371 (c)(1),
(2) Date: Feb. 26, 2016

(87) PCT Pub. No.: WO2015/027918
PCT Pub. Date: Mar. 5, 2015

(65) Prior Publication Data

US 2016/0200555 A1 Jul. 14, 2016

(30) Foreign Application Priority Data

Aug. 27, 2013 (CN) ..... 2013 1 0380406
Sep. 29, 2013 (CN) ..... 2013 1 0455185

(51) Int. Cl.
*B66C 23/00* (2006.01)
*B66C 23/70* (2006.01)

(52) U.S. Cl.
CPC ..... *B66C 23/706* (2013.01); *B66C 23/705* (2013.01); *B66C 23/708* (2013.01)

(58) Field of Classification Search
CPC ... B66C 23/705; B66C 23/706; B66C 23/707; B66C 23/708
See application file for complete search history.

(56) References Cited

U.S. PATENT DOCUMENTS 6,189,712 B1 2/2001 Conrad et al.

FOREIGN PATENT DOCUMENTS

CN 1994852 A 7/2007
CN 201272662 Y 7/2009
(Continued)

OTHER PUBLICATIONS

Patent Examination Report No. 1 for Australian Patent Application No. 2014314763, dated Jul. 16, 2016, 2 pages.
(Continued)

*Primary Examiner* — Emmanuel Monsayac Marcelo
(74) *Attorney, Agent, or Firm* — Kilpatrick Townsend & Stockton LLP

(57) ABSTRACT

The present invention relates to a single-cylinder plug pin type telescopic arm, a crane and a telescopic method thereof. The single-cylinder plug pin type telescopic arm includes a basic arm and at least one telescopic arm sleeved in the basic arm, wherein coaxial center holes are formed in the tails of the telescopic arms, and a telescopic oil cylinder is arranged in the center holes; the telescopic oil cylinder includes a cylinder rod and a cylinder barrel, at least two cylinder heads are fixedly sleeved on the outer side of the cylinder barrel in the longitudinal direction, and at least three arm pin holes
(Continued)

are formed in each of the basic arm and the telescopic arms in the longitudinal direction. The single-cylinder plug pin type telescopic arm provided by the present invention adopts one telescopic oil cylinder and at least two cylinder heads, each cylinder head is adapted to lock and unlock the telescopic oil cylinder and any telescopic arm, the telescopic arms are extended out or retracted in a relay transmission manner to achieve the extension and retraction of the single-cylinder plug pin type telescopic arm, the length of the oil cylinder is shortened, the cylinder diameter and the rod diameter of the oil cylinder are decreased, the cost of the oil cylinder is lowered, the upperstructure weight is reduced, the lifting capacity is improved, and there are more crane design spaces.

15 Claims, 17 Drawing Sheets

(56) References Cited

FOREIGN PATENT DOCUMENTS

| | | | | | |
|---|---|---|---|---|---|
| CN | 101618839 | B | | 1/2011 | |
| CN | 101973493 | A | | 2/2011 | |
| CN | 101979307 | A | * | 2/2011 | |
| CN | 102050393 | A | * | 5/2011 | |
| CN | 102070089 | A | | 5/2011 | |
| CN | 102358582 | A | | 2/2012 | |
| CN | 102730578 | A | | 10/2012 | |
| CN | 103058077 | A | | 4/2013 | |
| CN | 203048450 | U | * | 7/2013 | ..... B66C 23/36 |
| CN | 103407912 | A | | 11/2013 | |
| CN | 103527557 | A | | 1/2014 | |
| CN | 103603844 | A | | 2/2014 | |
| CN | 103693566 | A | | 4/2014 | |
| CN | 203529806 | U | | 4/2014 | |
| CN | 203670348 | U | | 6/2014 | |
| DE | 19824671 | A1 | | 12/1998 | |
| DE | 10004838 | A1 | | 9/2000 | |
| EP | 0661234 | A1 | | 7/1995 | |
| EP | 1072554 | A1 | | 1/2001 | |
| EP | 1072554 | B1 | | 3/2004 | |
| EP | 2392536 | A1 | | 12/2011 | |
| JP | H08157184 | A | | 6/1996 | |
| JP | 2003278715 | A | | 10/2003 | |
| JP | 2012166920 | A | | 9/2012 | |
| SU | 1221197 | A1 | | 3/1986 | |

OTHER PUBLICATIONS

Supplementary European Search Report dated Apr. 6, 2017 in the corresponding European application (14839217.8).
International Search Report of PCT /CN2014/085298.
First office action dated Sep. 2, 2014 in the corresponding CN priority patent application (201310380406.2).
First office action dated May 12, 2015 in the corresponding CN priority patent application (201310455185.0).
The CA First Office Action dated Dec. 5, 2017 in the corresponding CA Application (application No. 2922437.).
RU Search Report dated Nov. 7, 2017 in the corresponding PCT Application (application No. PCT/CN2014/085298.).

* cited by examiner

SINGLE-CYLINDER PLUG PIN TYPE TELESCOPIC ARM, TELESCOPIC METHOD THEREOF AND CRANE HAVING TELESCOPIC ARM

This application is a US National Stage of International Application No. PCT/CN2014/085298, filed on Aug. 27, 2014, designating the United States, and claiming the benefit of Chinese Patent Application No. 201310380406.2, filed with the State Intellectual Property Office of People's Republic of China on Aug. 27, 2013 and Chinese Patent Application No. 201310455185.0, filed with the State Intellectual Property Office of People's Republic of China on Sep. 29, 2013, which are hereby incorporated by reference in their entireties.

FIELD OF THE INVENTION

The present invention relates to the field of engineering machinery, and particularly relates to a single-cylinder plug pin type telescopic arm, a crane including the single-cylinder plug pin type telescopic arm, and a telescopic method of the single-cylinder plug pin type telescopic arm.

BACKGROUND OF THE INVENTION

A single-cylinder plug pin system is a device built in a crane boom for achieving a telescopic function of the crane boom which mainly comprises telescopic arms and a telescopic oil cylinder. The single-cylinder plug pin system includes arm pins, arm pin holes, a cylinder head, cylinder pins, a cylinder rod, a cylinder barrel, a dovetail groove, detection switches and other auxiliary facilities and is a main functional assembly for achieving extension and retraction of a lifting arm. The cylinder head is a device, which is located at a certain position of the cylinder barrel or the piston rod of the telescopic oil cylinder and is adopted to control fixation and separation of the telescopic oil cylinder and the telescopic arms, and the cylinder head mainly includes an arm pin driving device, cylinder pins, a driving oil cylinder, a position detection block, etc. The cylinder pin is a pin on the cylinder head of the telescopic oil cylinder and is adopted to lock the telescopic oil cylinder with the telescopic arms, and each cylinder head in an existing product generally includes 2 or 4 cylinder pins. The arm pin is a pin on the telescopic arm and is adopted to lock various telescopic arms, and each telescopic arm in the existing product generally includes 1 or 2 arm pins. The arm pin driving device is a device adopted to pull down or push up the arm pins and to lock or unlock the telescopic arms. The detection switches are sensors adopted to detect the arm positions of the telescopic arms and the locking and unlocking states of the cylinder pins or the arm pins.

FIG. 1*a* shows a single-cylinder plug pin type telescopic arm, this telescopic arm only includes one telescopic oil cylinder, the telescopic oil cylinder includes a movable cylinder barrel 1, a cylinder head 2 is fixedly sleeved on the outer side of the cylinder barrel 1 in the longitudinal direction, two cylinder pins 3 are correspondingly arranged on both sides of the cylinder head 2, and center shafts of the two cylinder pins 3 and a center shaft of the telescopic oil cylinder are coplanar; and the telescopic oil cylinder can selectively lock or release a relative position of the telescopic oil cylinder and any telescopic arm 4 through the cylinder pins 3. In addition, arm pins 6 are arranged between adjacent telescopic arms 4 and between a basic arm 5 (a lifting arm directly pivoted with a crane upperstructure) and the first telescopic arm, and the relative positions between the adjacent telescopic arms 4 and between the basic arm 5 and the first telescopic arm can be selectively locked or released through the arm pins 6.

As shown in FIG. 1*a* to FIG. 1*g*, the extension manner of the single-cylinder plug pin type telescopic arm in the prior art is as follows: the telescopic oil cylinder can be locked with the last telescopic arm at first, and then the last telescopic arm and the second-to-last telescopic arm are released, and at this time, the telescopic oil cylinder can bring out the last telescopic arm; and after arriving at a predetermined position, the last telescopic arm is locked with the second-to-last telescopic arm again, the telescopic oil cylinder is retracted and is locked with the second-to-last telescopic arm, then the second-to-last telescopic arm and the third-to-last telescopic arm are unlocked, at this time, the telescopic oil cylinder can bring out the second-to-last telescopic arm, and after arriving at the predetermined position, the second-to-last telescopic arm is locked with the third-to-last telescopic arm again. By analogy, the telescopic arms can be extended out in turn. Of course, at any moment, any telescopic arm is either locked with other telescopic arms through the arm pins or locked with the telescopic oil cylinder through the cylinder pins.

In the existing single-cylinder plug pin type telescopic manner, the stroke of the telescopic oil cylinder is greater than the maximal stroke of each telescopic arm, and a telescopic arm can be extended from a complete retraction state to a 100% complete extension state at one time.

The single-cylinder plug pin type telescopic arm in the prior art has the following disadvantages:

1. To ensure that the oil cylinder can achieve such a large stroke and can propel the telescopic arms to extend out stably, the cylinder rod and the cylinder barrel of the oil cylinder are required to be very thick and long, meanwhile more oil is needed, and thus a hydraulic system needs to be configured with a larger oil tank to meet telescopic demands. It results in a very high cost of the oil cylinder and an overlarge weight of the crane upperstructure, indirectly increases the weight of a chassis, limits the lifting performance, approaches to the lowest requirement of the national standard and greatly affects the competitive advantage of the product.

2. The cost is high. The stroke of the telescopic oil cylinder needs to meet the extension stroke of each telescopic arm, resulting in that the stroke of the telescopic oil cylinder is too long. The cylinder rod and the cylinder barrel of a long oil cylinder are difficult to be processed, and professional and special processing equipment and processing conditions are needed, such that the cost of the telescopic oil cylinder is greatly increased.

3. The weight is large. As the telescopic oil cylinder is too long and needs to bear larger axial compression load, to prevent longitudinal bending of the telescopic oil cylinder and meet the stability requirement, larger rod diameter, cylinder diameter and material thickness of the oil cylinder are required, and a longer guide distance is required, thereby increasing the weight of the telescopic oil cylinder. Meanwhile, to meet the telescopic demand of a large-stroke oil cylinder, an oil tank with a larger size needs to be configured, and this increases the weight of the crane.

Since the weights of road vehicles are exactly regulated in the national traffic regulations, the increase of the weight causes a complex design of the crane, and the vehicle toll is increased accordingly.

4. The stability is poor. In the long-stroke telescopic oil cylinder, after the cylinder rod extends out, due to the overlarge weight per se, the connecting positions of the cylinder rod and the cylinder barrel at the middles are bent downwards, which increases the friction force of the telescopic oil cylinder. Meanwhile, due to the influence of the elastic modulus of hydraulic oil, a creeping condition occurs during the latter half of extension of the oil cylinder to cause a chattering phenomenon.

SUMMARY OF THE INVENTION

The purpose of the present invention is to provide a single-cylinder plug pin type telescopic arm, a crane including the single-cylinder plug pin type telescopic arm, and a telescopic method of the single-cylinder plug pin type telescopic arm. The single-cylinder plug pin type telescopic arm is used for effectively solving the above problems, is simple in structure and is convenient to operate.

To achieve the above purpose, the present invention provides a single-cylinder plug pin type telescopic arm, including a basic arm and at least one telescopic arm sleeved in the basic arm, wherein coaxial center holes are formed in the tails of the telescopic arms, and a telescopic oil cylinder is arranged in the center holes; the telescopic oil cylinder includes a cylinder rod and a cylinder barrel, the cylinder rod is connected to a root hinge point of the basic arm, at least two cylinder heads are fixedly sleeved on the outer side of the cylinder barrel in the longitudinal direction, telescopic cylinder pins are arranged on left and right sides of each cylinder head, cylinder pin holes are formed in the inner peripheral walls of the center holes at the tails of the telescopic arms, and the cylinder barrel is adapted to be selectively and fixedly connected with any telescopic arm by means of the cooperation of the cylinder pins and the cylinder pin holes; and at least three arm pin holes are formed in each of the basic arm and the telescopic arms in the longitudinal direction, the number of the arm pin holes of each arm is at least one more than that of the cylinder heads, telescopic arm pins are arranged on the outer peripheral walls of the telescopic arms, and the basic arm, the first telescopic arm and adjacent telescopic arms are adapted to be locked or released through the cooperation of the arm pins and the arm pin holes.

Preferably, the number of the arm pin holes of each arm is one more than that of the cylinder heads.

Preferably, two cylinder heads are fixedly sleeved on the outer side of the cylinder barrel in the longitudinal direction, and three arm pin holes are formed in each of the basic arm and the telescopic arms in the longitudinal direction.

Preferably, cylinder pin mounting holes are formed at both sides of the cylinder heads, and the cylinder pins are mounted in the cylinder pin mounting holes.

Preferably, the arm pins are driven by two arm pin oil cylinders, the arm pin oil cylinders are arranged in arm pin oil cylinder mounting holes of the cylinder heads, and the arm pin oil cylinders are respectively located on both sides of the cylinder heads.

Preferably, each cylinder head is a rectangular parallelepiped, a central mounting hole running through each cylinder head is formed in the middle thereof, and the inside diameter of the central mounting hole is equal to the outside diameter of the cylinder barrel to enable the cylinder barrel to pass through the central mounting hole.

Preferably, the single-cylinder plug pin type telescopic arm further includes a single-cylinder plug pin mechanism; the cylinder head includes a cylinder head body, and the cylinder pins are adapted to extend out or retract relatively to the cylinder head body along a first direction; the single-cylinder plug pin mechanism includes: a dovetail groove extending out or retracting relatively to the cylinder head body along a second direction, a cylinder pin oil cylinder providing a driving force to the cylinder pins and an arm pin oil cylinder providing a driving force to the dovetail groove; wherein the first direction is vertical to the second direction; the cylinder pin oil cylinder and the arm pin oil cylinder are arranged on the same side of the cylinder head body along a third direction, and the third direction is vertical to the first direction and the second direction; the single-cylinder plug pin mechanism further includes: a cylinder pin driving slide block connected with the movable end of the cylinder pin oil cylinder, a first inclined plane sliding fit pair is arranged between the cylinder pin driving slide block and the cylinder pins, the first inclined plane sliding fit pair is adapted to relatively slide in a plane formed by the first direction and the third direction, a first direction sliding fit pair is arranged between the cylinder pins and the cylinder head body, to drive the cylinder pins to extend out or retract through the cylinder pin oil cylinder; and an arm pin driving slide block connected with the movable end of the arm pin oil cylinder, a second inclined plane sliding fit pair is arranged between the arm pin driving slide block and the dovetail groove, the second inclined plane sliding fit pair is adapted to relatively slide in a plane formed by the second direction and the third direction, and a second direction sliding fit pair is arranged between the dovetail groove and the cylinder head body, to drive the dovetail groove to extend out or retract through the arm pin oil cylinder.

Preferably, a first pin formed by extending along the second direction is arranged on each cylinder pin, a first chute is obliquely formed on the cylinder pin driving slide block, and the first pin is inserted in the first chute to form the first inclined plane sliding fit pair; a second pin formed by extending along the first direction is arranged on the dovetail groove, a second chute is obliquely formed on the arm pin driving slide block, and the second pin is inserted in the second chute to form the second inclined plane sliding fit pair; and the second direction sliding fit pair is formed between a guide block which is provided on the second pin on the dovetail groove and a vertical guide groove which is fixedly arranged on the cylinder head body.

Preferably, the single-cylinder plug pin mechanism further includes an interlocking block which synchronously moves with the cylinder pin driving slide block, and the interlocking block is configured as follows: the dovetail groove at a retraction state abuts against the interlocking block along the third direction to limit the cylinder pin driving slide block from driving the cylinder pins to retract; and the interlocking block at the retraction state abuts against the dovetail groove along the second direction to limit the arm pin driving slide block from driving the dovetail groove to retract.

Preferably, two cylinder pins and two cylinder pin driving slide blocks are arranged and are symmetrically arranged on both sides of the dovetail groove respectively; the two cylinder pin driving slide blocks are connected together by a first bracket, and the interlocking block is fixedly arranged on the first bracket; two arm pin driving slide blocks are symmetrically arranged on both sides of the dovetail groove respectively; and the two arm pin driving slide blocks are connected together by a second bracket.

Preferably, both of the cylinder pin driving slide block and the arm pin driving slide block are made of a non-metal material, and both of the first bracket and the second bracket are made of a metal material; two groups of proximity switches correspond to the first bracket and the second bracket respectively, each group of proximity switches is provided with two proximity switches and is configured as follows: when the slide blocks are at an extension state, the corresponding bracket is located in a detection region of one proximity switch; and when the slide blocks are at the retraction state, the corresponding bracket is located in a detection region of the other proximity switch.

Preferably, both of the cylinder pin oil cylinder and the arm pin oil cylinder are single acting cylinders for providing corresponding retraction acting forces; the movable end of the cylinder pin oil cylinder is connected with the cylinder pin driving slide block through a cylinder pin connecting rod, and the movable end of the arm pin oil cylinder is connected with the arm pin driving slide block through an arm pin connecting rod; and both of the cylinder pin connecting rod and the arm pin connecting rod are inserted in a movable baffle and a fixed baffle, and an elastic component is arranged between the movable baffle and the fixed baffle to provide a corresponding extension acting force.

Preferably, the elastic component is specifically a compression spring sleeved on the arm pin connecting rod or the cylinder pin connecting rod.

Preferably, there are one cylinder pin oil cylinder and one cylinder pin connecting rod, and two arm pin oil cylinders and two arm pin connecting rods are symmetrically arranged relatively to the cylinder pin oil cylinder; and the cylinder pin oil cylinder and the two arm pin oil cylinders are arranged sequentially along the first direction.

Preferably, the displacement distance of the first inclined plane sliding fit pair along the third direction is greater than the displacement distance of the same along the first direction; and the displacement distance of the second inclined plane sliding fit pair along the third direction is greater than the displacement distance of the same along the second direction.

The present invention provides a crane including the above-mentioned single-cylinder plug pin type telescopic arm.

The present invention provides a telescopic method of the single-cylinder plug pin type telescopic arm, including: retracting the cylinder pins of the cylinder heads, moving the cylinder barrel, and when the cylinder pins of the first cylinder head of the cylinder barrel arrive at the positions of the cylinder pin holes of the last telescopic arm, inserting the cylinder pins of the first cylinder head into the cylinder pin holes of the last telescopic arm to lock the cylinder barrel with the last telescopic arm; pulling down the arm pins of the last telescopic arm to release the last telescopic arm and the second-to-last telescopic arm; bringing out the last telescopic arm through the cylinder barrel, and when the arm pins of the last telescopic arm arrive at the position of the second arm pin hole of the second-to-last telescopic arm, inserting the arm pins of the last telescopic arm into the second arm pin hole of the second-to-last telescopic arm to lock the last telescopic arm and the second-to-last telescopic arm; sequentially performing the operation steps of the first cylinder head on the rest cylinder heads of the cylinder barrel to completely extend out the last telescopic arm; and sequentially extending out the rest telescopic arms according to the extension steps of the last telescopic arm to extend out all the telescopic arms.

Preferably, the telescopic method includes: retracting the cylinder pins of the cylinder heads, moving the cylinder barrel, and when the cylinder pins of the last cylinder head of the cylinder barrel arrive at the positions of the cylinder pin holes of the first telescopic arm, inserting the cylinder pins of the last cylinder head into the cylinder pin holes of the first telescopic arm to lock the cylinder barrel with the first telescopic arm; pulling down the arm pins of the first telescopic arm to release the basic arm and the first telescopic arm; bringing back the first telescopic arm through the cylinder barrel, and when the arm pins of the first telescopic arm arrive at the position of the second-to-last arm pin hole of the basic arm, inserting the arm pins of the first telescopic arm into the second-to-last arm pin hole of the basic arm to lock the basic arm and the first telescopic arm; sequentially performing the operation steps of the last cylinder head on the rest cylinder heads of the cylinder barrel to completely retract the first telescopic arm; and sequentially retracting the rest telescopic arms according to the retraction steps of the first telescopic arm to retract all the telescopic arms.

Preferably, the cylinder pins of all the cylinder heads are linked to synchronously extend out or synchronously retract.

Based on the above technical solutions, the present invention has the following advantages:

since the single-cylinder plug pin type telescopic arm provided by the present invention adopts one telescopic oil cylinder and at least two cylinder heads, each cylinder head can lock and unlock the telescopic oil cylinder and any telescopic arm, the telescopic arms are extended out or retracted in a relay transmission manner to achieve the extension and retraction of the single-cylinder plug pin type telescopic arm, the length of the oil cylinder is shortened, the cylinder diameter and the rod diameter of the oil cylinder are decreased, the cost of the oil cylinder is lowered, meanwhile, the size of the oil tank can be reduced, the upperstructure weight is reduced, the lifting capacity is improved, and there are more crane design spaces.

Besides, the preferred technical solutions of the present invention at least have the following advantages:

1. The cost is low. The telescopic arms are extended out or retracted in segments, so the necessary stroke of the telescopic oil cylinder is decreased, and thus the telescopic oil cylinder is shorter. The cylinder barrel and the cylinder rod of the short oil cylinder are shorter, thereby being more convenient to process and reducing the requirements on the processing equipment and the processing conditions, therefore the cost of the telescopic oil cylinder is greatly reduced.

2. The weight is light. Since the telescopic oil cylinder is shortened, the weight per se is reduced. As the lifting arm is unchanged, the lifting arm bears the same axial compression load, at this time, the rod diameter, the cylinder diameter and the material thickness can be properly reduced to shorten the guide distance of the telescopic oil cylinder, which can prevent longitudinal bending of the telescopic oil cylinder, meet the stability requirements as well and reduce the weight of the telescopic oil cylinder. In addition, to satisfy the extension and retraction of the short-stroke oil cylinder, an oil tank with a smaller size can be configured to reduce the weight of the crane. Since the weight is reduced, a designer can have more design spaces.

3. The stability is better. As the stroke of the oil cylinder is shortened, the processing conditions thereof are better, the surface smoothness is higher and the friction force is smaller. In addition, the influence of the elastic modulus of hydraulic oil on the telescopic oil cylinder is smaller, so that the creeping condition of the telescopic oil cylinder can be relieved to reduce chattering failure.

BRIEF DESCRIPTION OF THE DRAWINGS

Accompanying drawings illustrated herein are used for providing further understanding of the present invention and constitute a part of the present application, and schematic embodiments of the present invention and the illustration thereof are used for explaining the present invention, rather than constituting improper limitation to the present invention. In the accompanying drawings:

FIG. 1*a* to FIG. 1*g* are schematic diagrams of an extension process of a single-cylinder plug pin type telescopic arm in the prior art, wherein FIG. 1*a* is a schematic diagram of a complete retraction state, FIG. 1*b* is a schematic state diagram of retracting a cylinder pin and looking for a cylinder pin hole of the last telescopic arm, FIG. 1*c* is schematic state diagram of finding the cylinder pin hole of the last telescopic arm, inserting the cylinder pin and pulling down an arm pin, FIG. 1*d* is a schematic state diagram of inserting the arm pin of the last telescopic arm into an arm pin hole of the second-to-last telescopic arm, FIG. 1*e* is a schematic state diagram of retracting the cylinder pin, retracting a telescopic oil cylinder and looking for the cylinder pin hole of the second-to-last telescopic arm, FIG. 1*f* is a schematic state diagram of finding the cylinder pin hole of the second-to-last telescopic arm, inserting the cylinder pin and pulling down the arm pin, and FIG. 1*g* is a schematic state diagram of inserting the arm pin of the second-to-last telescopic arm into the arm pin hole of the third-to-last telescopic arm;

FIG. 2*a*-FIG. 2*k* are schematic diagrams of an extension process of a preferred embodiment of a single-cylinder plug pin type telescopic arm in the present invention, wherein FIG. 2*a* is a schematic diagram of a complete retraction state, FIG. 2*b* is a schematic state diagram of retracting a cylinder pin and looking for the cylinder pin hole of the last telescopic arm, FIG. 2*c* is schematic state diagram of finding the cylinder pin hole of the last telescopic arm, inserting the first cylinder pin and pulling down the arm pin, FIG. 2*d* is a schematic state diagram of inserting the arm pin of the last telescopic arm into the second arm pin hole of the second-to-last telescopic arm, FIG. 2*e* is a schematic state diagram of finding the cylinder pin hole of the last telescopic arm, inserting the second cylinder pin and pulling down the arm pin, FIG. 2*f* is a schematic state diagram of inserting the arm pin of the last telescopic arm into the second arm pin hole of the second-to-last telescopic arm, FIG. 2*g* is a schematic state diagram of retracting the cylinder pins and looking for the cylinder pin hole of the second-to-last telescopic arm, FIG. 2*h* is a schematic state diagram of finding the cylinder pin hole of the second-to-last telescopic arm, inserting the first cylinder pin and pulling down the arm pin, FIG. 2*i* is a schematic state diagram of inserting the arm pin of the second-to-last telescopic arm into the second arm pin hole of the third-to-last telescopic arm, FIG. 2*j* is a schematic state diagram of inserting the arm pin of the second-to-last telescopic arm into the third arm pin hole of the third-to-last telescopic arm, and FIG. 2*k* is a schematic diagram of a complete extension state;

FIG. 3*a* to FIG. 3*m* are schematic diagrams of a retraction process of a preferred embodiment of a single-cylinder plug pin type telescopic arm in the present invention, wherein FIG. 3*a* is a schematic diagram of a complete extension state, FIG. 3*b* is a schematic state diagram of retracting the cylinder pin and looking for the cylinder pin hole of the fifth-to-last telescopic arm, FIG. 3*c* is a schematic state diagram of finding the cylinder pin hole of the fifth-to-last telescopic arm, inserting the second cylinder pins and pulling down the arm pin, FIG. 3*d* is a schematic state diagram of retracting the fifth-to-last telescopic arm via the telescopic oil cylinder, FIG. 3*e* is a schematic state diagram of inserting the arm pin of the fifth-to-last telescopic arm into the second arm pin hole of the basic arm, FIG. 3*f* is a schematic state diagram of retracting the cylinder pin and looking for the cylinder pin hole of the fifth-to-last telescopic arm, FIG. 3*g* is a schematic state diagram of finding the cylinder pin hole of the fifth-to-last telescopic arm, inserting the first cylinder pin and pulling down the arm pin, FIG. 3*h* is a schematic state diagram of inserting the arm pin of the fifth-to-last telescopic arm into the first arm pin hole of the basic arm, FIG. 3*i* is a schematic state diagram of finding the cylinder pin hole of the fourth-to-last telescopic arm, inserting the second cylinder pin and pulling down the arm pin, FIG. 3*j* is a schematic state diagram of inserting the arm pin of the fourth-to-last telescopic arm into the second arm pin hole of the fifth-to-last telescopic arm, FIG. 3*k* is a schematic state diagram of finding the cylinder pin hole of the fourth-to-last telescopic arm, inserting the first cylinder pin and pulling down the arm pin, FIG. 3*l* is a schematic state diagram of inserting the arm pin of the fourth-to-last telescopic arm into the first arm pin hole of the fifth-to-last telescopic arm, and FIG. 3*m* is a schematic diagram of a complete retraction state;

DETAILED DESCRIPTION OF THE EMBODIMENTS

Figure 1A:
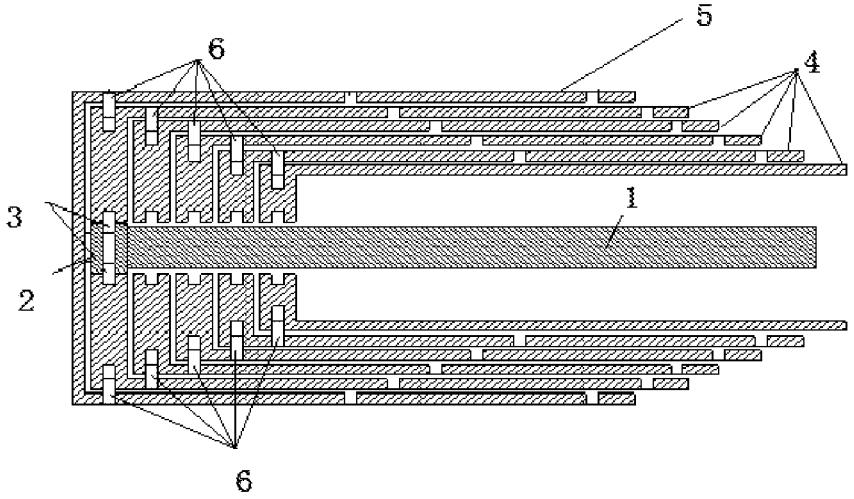
Figure 1B:
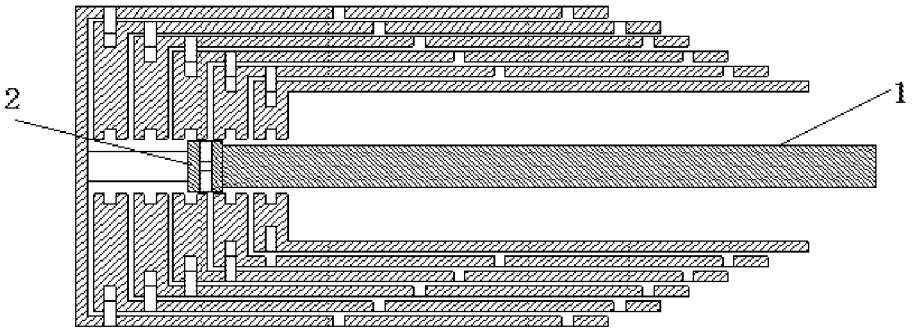
Figure 1C:
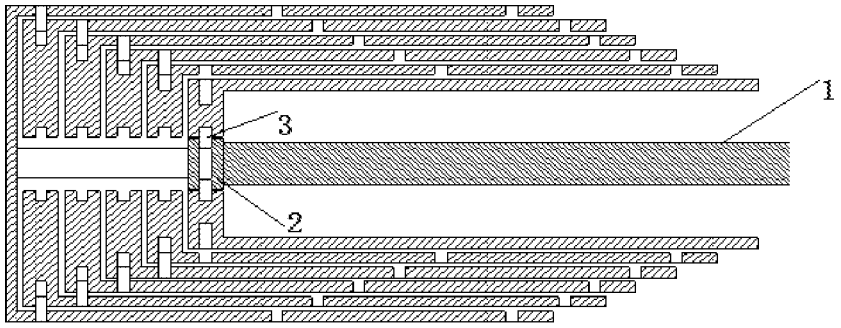
Figure 1D:
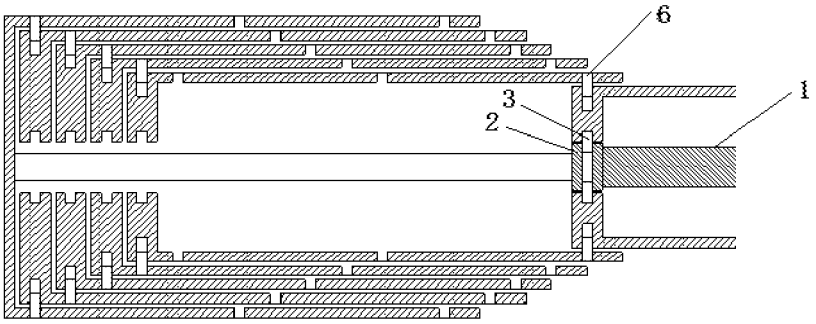
Figure 1E:
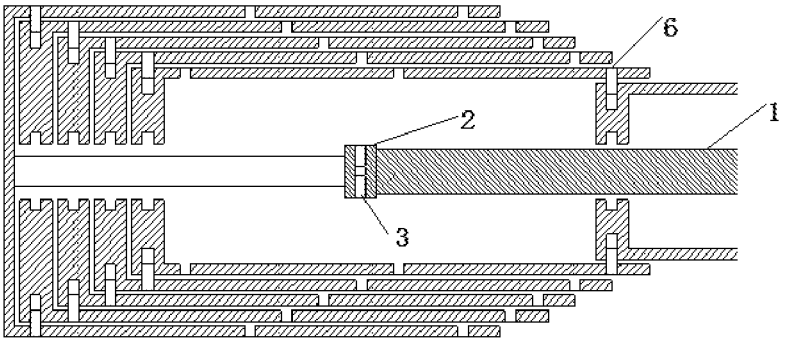
Figure 1F:
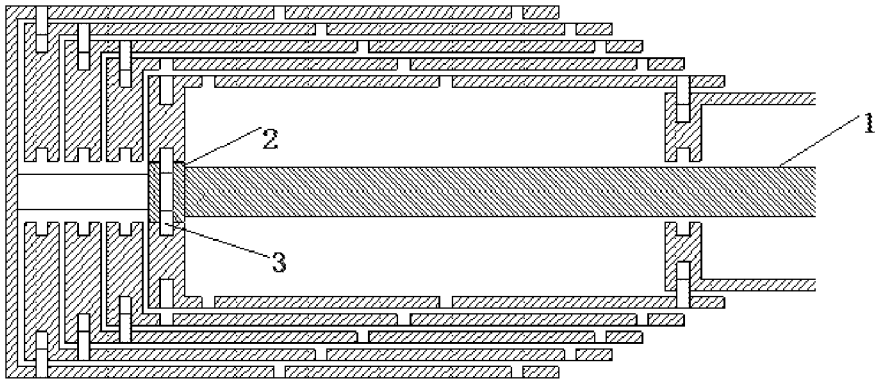
Figure 1G:
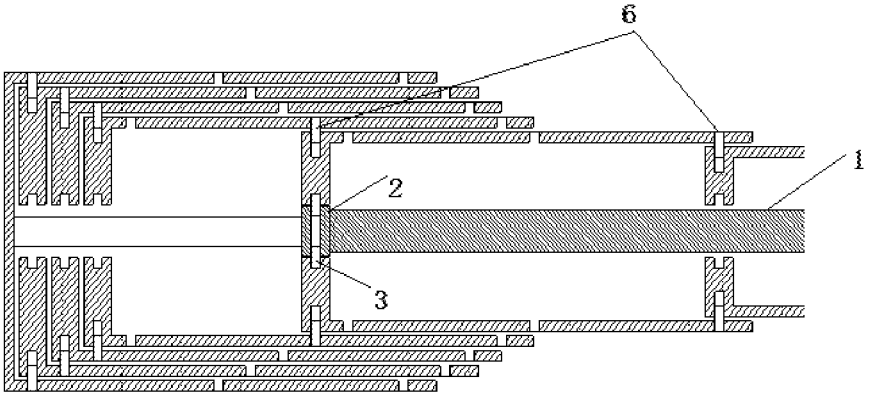

Referring to FIG. 2*a* to FIG. 14, a further detailed description of technical solutions of the present invention will be given below in combination with the accompanying drawings and embodiments.

For the convenience of description below, so-called 'left', 'right', 'upper' and 'lower' hereinafter are consistent with left, right, upper and lower directions of the accompanying drawings.

At least two cylinder heads refer to two or more cylinder heads.

For the convenience of description below, with the left-to-right direction in the accompanying drawings as reference, the at least two cylinder heads are respectively distinguished as the first cylinder head, the second cylinder head and the third cylinder head (and so on); and with the right-to-left direction in the accompanying drawings as reference, the at least two cylinder heads are respectively distinguished as the last cylinder head, the second-to-last cylinder head and the third-to-last cylinder head (and so on), but the sizes, structures and materials of all the cylinder heads are the same. For example, when two cylinder heads are provided, with the left-to-right direction in the accompanying drawings as reference, the two cylinder heads are respectively distinguished as the first cylinder head and the second cylinder head, and with the right-to-left direction in the accompanying drawings as reference, the two cylinder heads are respectively distinguished as the last cylinder head and the second-to-last cylinder head, that is, the first cylinder head is the second-to-last cylinder head, and the second cylinder head is the last cylinder head. When five cylinder heads are provided, with the left-to-right direction in the accompanying drawings as reference, the five cylinder heads are respectively distinguished as the first cylinder head, the second cylinder head, the third cylinder head, the fourth cylinder head and the fifth cylinder head, and with the right-to-left direction in the accompanying drawings as reference, the five cylinder heads are respectively distinguished as the last cylinder head, the second-to-last cylinder head, the third-to-last cylinder head, the fourth-to-last cylinder head and the fifth-to-last cylinder head, that is, the first cylinder head is the fifth-to-last cylinder head, the second cylinder head is the fourth-to-last cylinder head, the third cylinder head is the third-to-last cylinder head, the fourth cylinder head is the second-to-last cylinder head, and the fifth cylinder head is the last cylinder head.

At least three arm pin holes refer to three or more arm pin holes.

For the convenience of description below, with the left-to-right direction in the accompanying drawings as reference, the at least three arm pin holes are respectively distinguished as the first arm pin hole, the second arm pin hole and the third arm pin hole (and so on); and with the right-to-left direction in the accompanying drawings as reference, the at least three arm pin holes are respectively distinguished as the last arm pin hole, the second-to-last arm pin hole and the third-to-last arm pin hole (and so on), and the arrangement law of the arm pin holes of each telescopic arm is the same. For example, when three arm pin holes are provided, with the left-to-right direction in the accompanying drawings as reference, the three arm pin holes are respectively distinguished as the first arm pin hole, the second arm pin hole and the third arm pin hole, and with the right-to-left direction in the accompanying drawings as reference, the three arm pin holes are respectively distinguished as the last arm pin hole, the second-to-last arm pin hole and the third-to-last arm pin hole, that is, the first arm pin hole is the third-to-last arm pin hole, the second arm pin hole is the second-to-last arm pin hole, and the third arm pin hole is the last arm pin hole. When five arm pin holes are provided, with the left-to-right direction in the accompanying drawings as reference, the five arm pin holes are respectively distinguished as the first arm pin hole, the second arm pin hole, the third arm pin hole, the fourth arm pin hole and the fifth arm pin hole, and with the right-to-left direction in the accompanying drawings as reference, the five arm pin holes are respectively distinguished as the last arm pin hole, the second-to-last arm pin hole, the third-to-last arm pin hole, the fourth-to-last arm pin hole and the fifth-to-last arm pin hole, that is, the first arm pin hole is the fifth-to-last arm pin hole, the second arm pin hole is the fourth-to-last arm pin hole, the third arm pin hole is the third-to-last arm pin hole, the fourth arm pin hole is the second-to-last arm pin hole, and the fifth arm pin hole is the last arm pin hole.

For the convenience of description below, with the outside-to-inside direction in the accompanying drawings as reference, at least one telescopic arm is respectively distinguished as the first telescopic arm, the second telescopic arm and the third telescopic arm (and so on); and with the inside-to-outside direction in the accompanying drawings as reference, the at least one telescopic arm is respectively distinguished as the last telescopic arm, the second-to-last telescopic arm and the third-to-last telescopic arm (and so on), only radial sizes are different, and the structure and the material are the same. The radial sizes of a plurality of telescopic arms need to meet the following conditions: the third telescopic arm can be arranged in the inner cavity of the second telescopic arm, the second telescopic arm can be arranged in the inner cavity of the first telescopic arm, and the first telescopic arm can be arranged in the inner cavity of the basic arm. For example, when two telescopic arms are provided, with the outside-to-inside direction in the accompanying drawings as reference, the two telescopic arms are respectively distinguished as the first telescopic arm and the second telescopic arm, with the inside-to-outside direction in the accompanying drawings as reference, the two telescopic arms are respectively distinguished as the last telescopic arm and the second-to-last telescopic arm, that is, the first telescopic arm is the second-to-last telescopic arm, and the second telescopic arm is the last telescopic arm, and the radial sizes of the two telescopic arms need to meet the following conditions: the second telescopic arm can be arranged in the inner cavity of the first telescopic arm, and the first telescopic arm can be arranged in the inner cavity of the basic arm. When five telescopic arms are provided, with the outside-to-inside direction in the accompanying drawings as reference, the five telescopic arms are respectively distinguished as the first telescopic arm, the second telescopic arm, the third telescopic arm, the fourth telescopic arm and the fifth telescopic arm, with the inside-to-outside direction in the accompanying drawings as reference, the five telescopic arms are respectively distinguished as the last telescopic arm, the second-to-last telescopic arm, the third-to-last telescopic arm, the fourth-to-last telescopic arm and the fifth-to-last telescopic arm, that is, the first telescopic arm is the fifth-to-last telescopic arm, the second telescopic arm is the fourth-to-last telescopic arm, the third telescopic arm is the third-to-last telescopic arm, the fourth telescopic arm is the second-to-last telescopic arm, and the fifth telescopic arm is the last telescopic arm, and the radial sizes of the five telescopic arms need to meet the following conditions: the fifth telescopic arm can be arranged in the inner cavity of the fourth telescopic arm, the fourth telescopic arm can be arranged in the inner cavity of the third telescopic arm, the third telescopic arm can be arranged in the inner cavity of the second telescopic arm, the second telescopic arm can be arranged in the inner cavity of the first telescopic arm, and the first telescopic arm can be arranged in the inner cavity of the basic arm.

If two cylinder heads are arranged on the oil cylinder, the extension and retraction of each telescopic arm are carried out in two segments, the first cylinder head is responsible for the extension and retraction of the former segment, and the second cylinder head is responsible for the extension and retraction of the latter segment; if three cylinder heads are arranged on the oil cylinder, the first cylinder head is responsible for the extension and retraction of the former segment of the telescopic arm, the second cylinder head is responsible for the extension and retraction of the middle segment, and the third cylinder head is responsible for the extension and retraction of the latter segment; and if four or more cylinder heads are arranged on the oil cylinder, they can be done in the same manner.

Figure 2A:
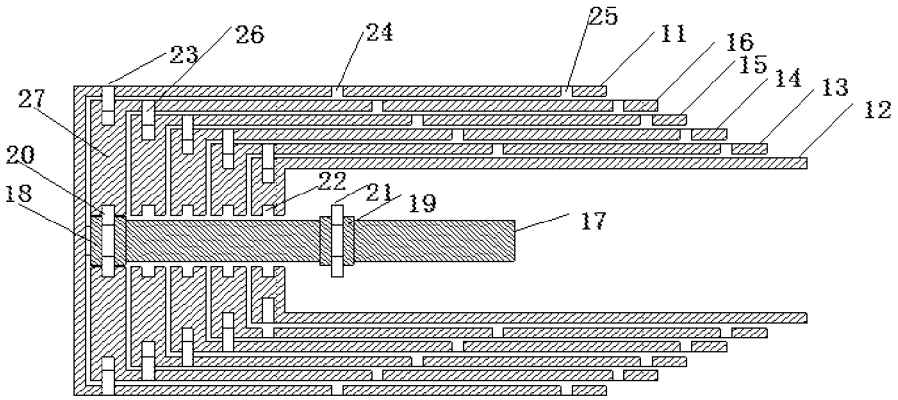
Figure 2B:
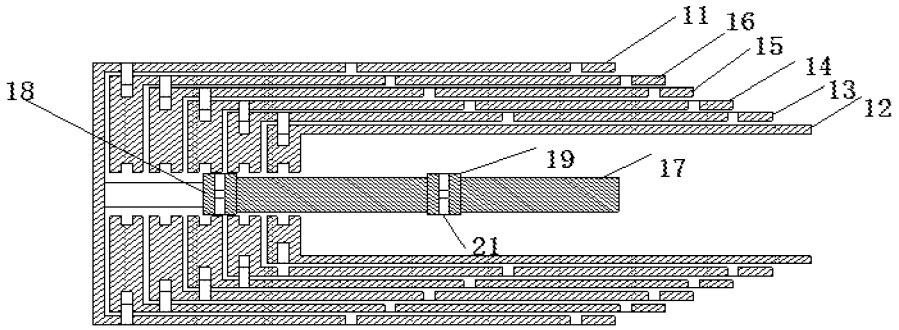
Figure 2C:
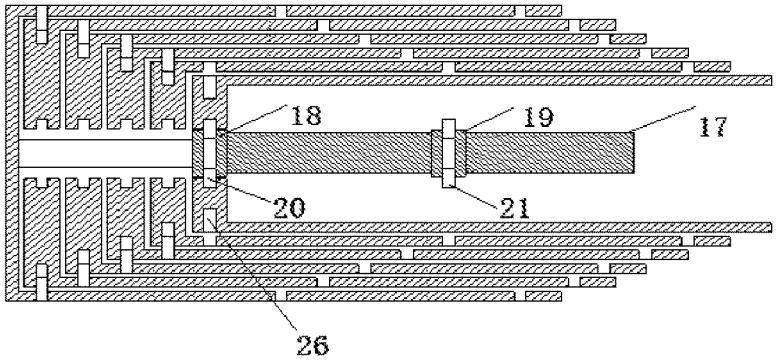
Figure 2D:
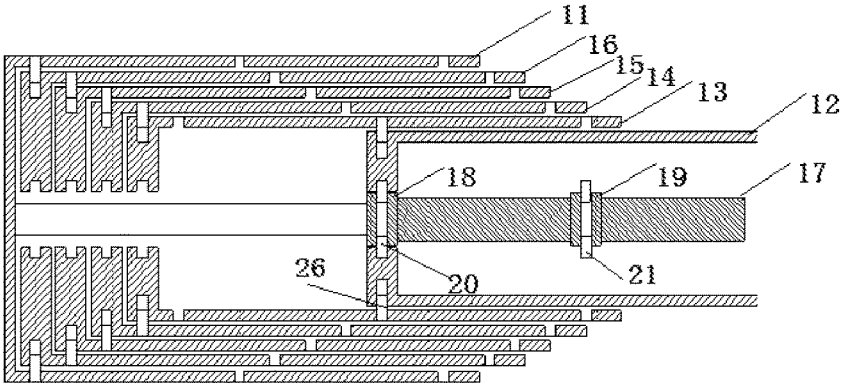
Figure 2E:
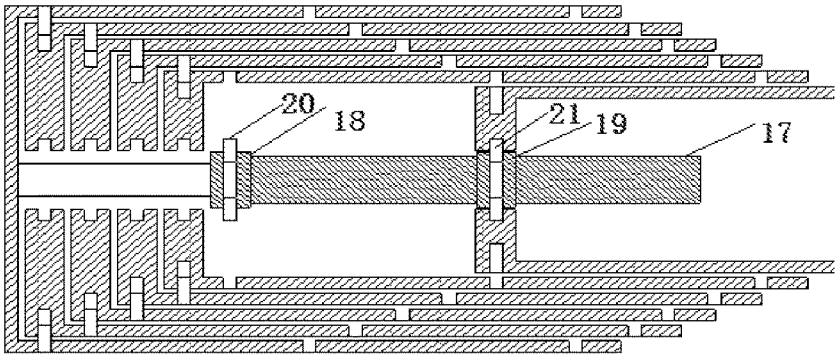
Figure 2F:
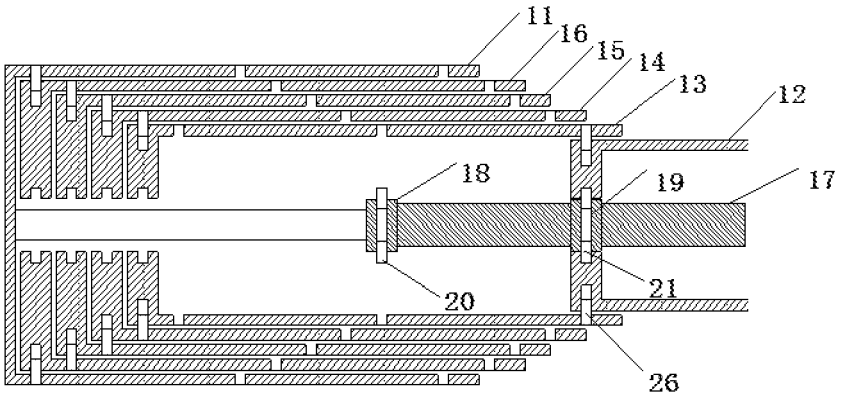
Figure 2G:
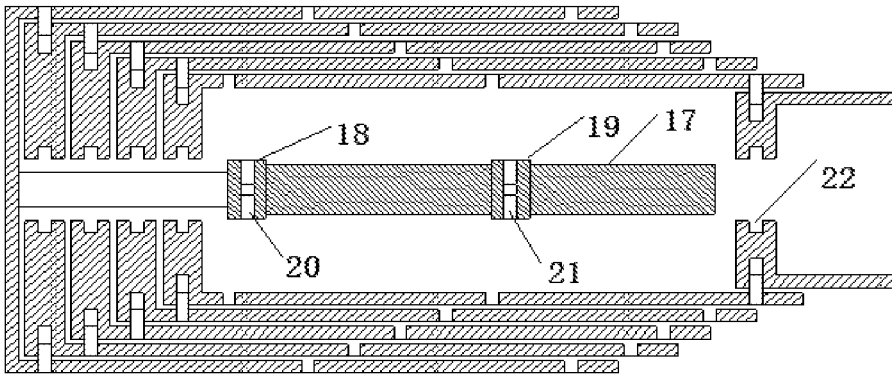
Figure 2H:
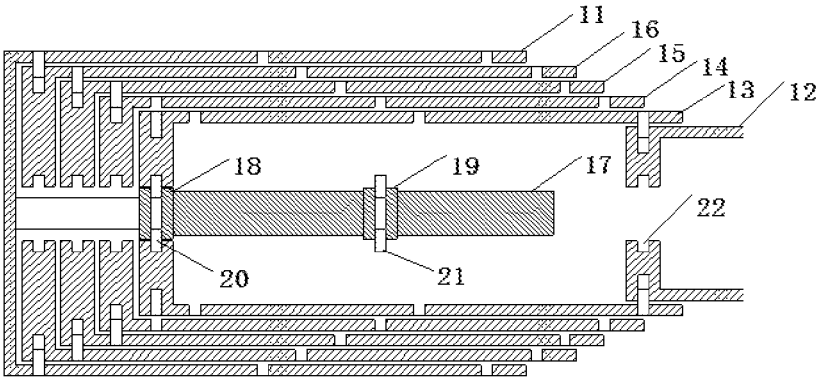
Figure 2I:
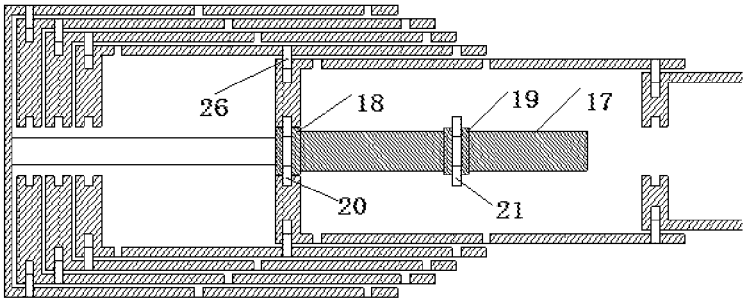
Figure 2J:
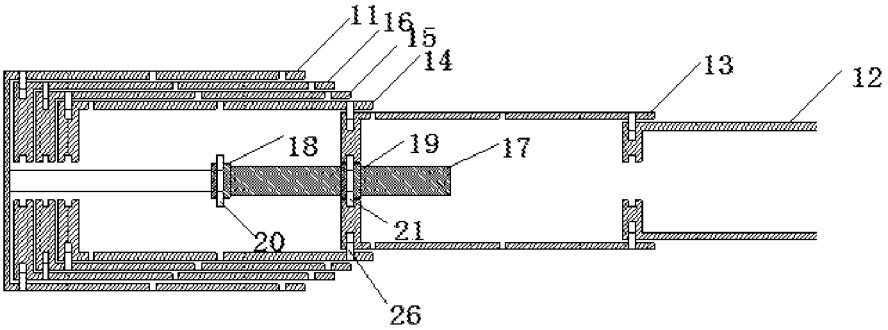
Figure 2K:
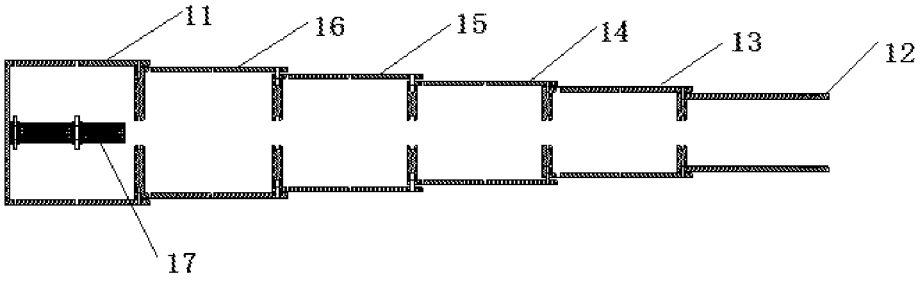
Figure 3A:
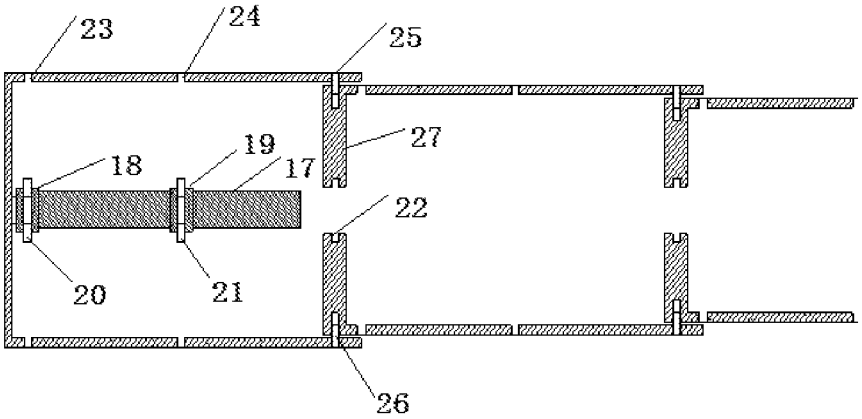
Figure 3B:
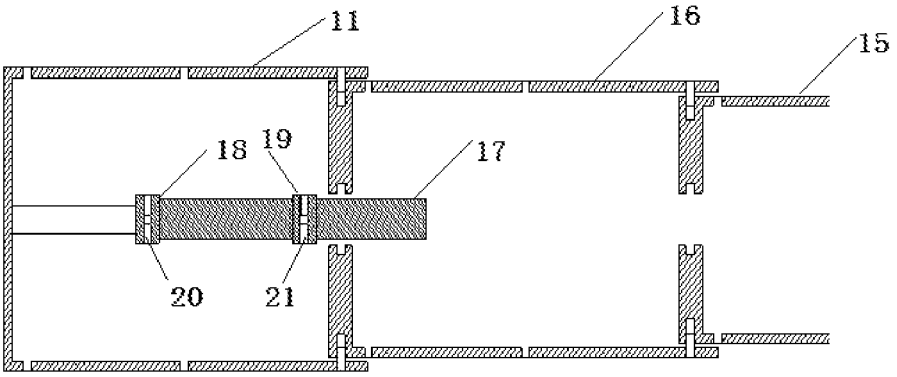
Figure 3C:
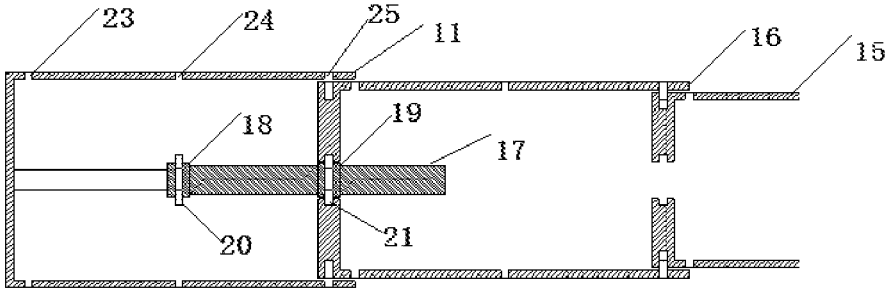
Figure 3D:
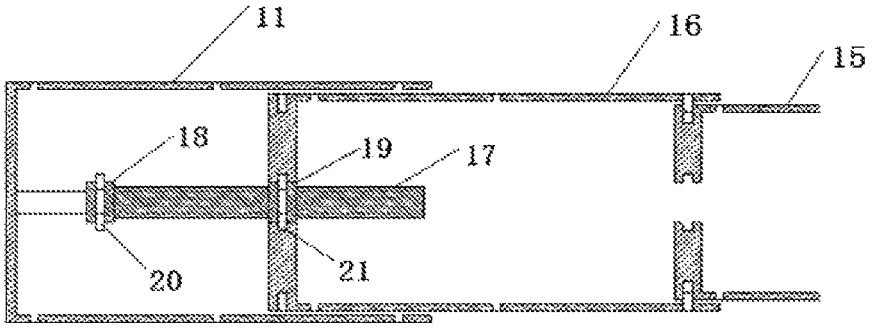
Figure 3E:
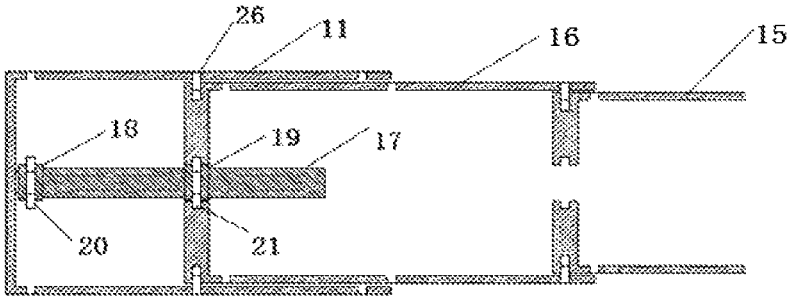
Figure 3F:
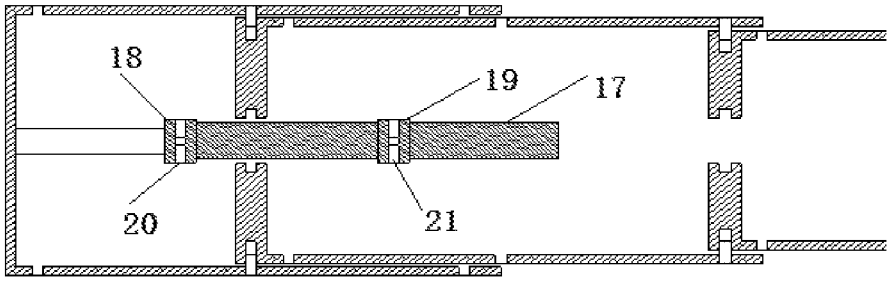
Figure 3G:
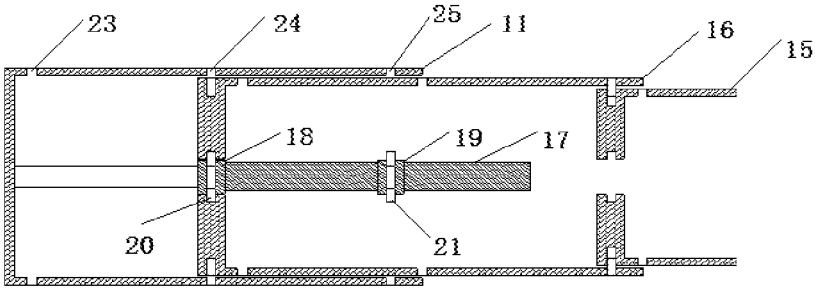
Figure 3H:
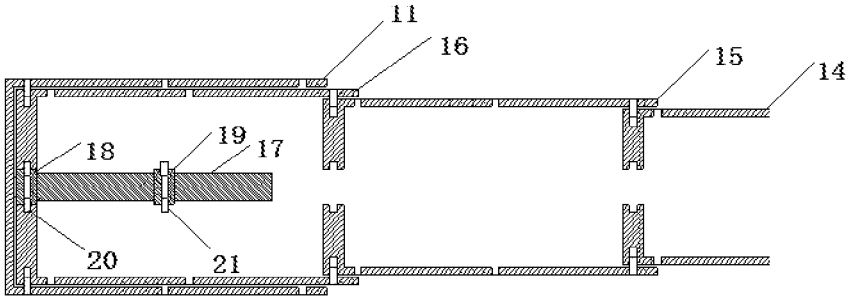
Figure 3I:
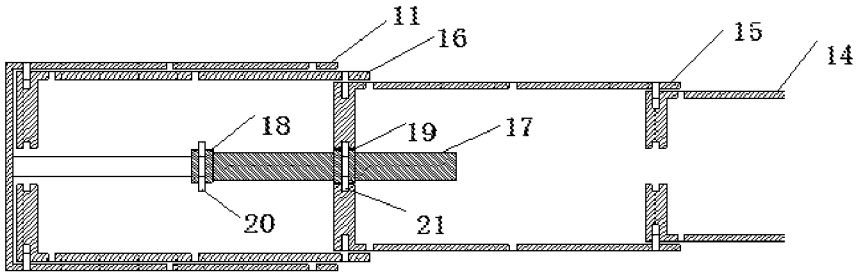
Figure 3J:
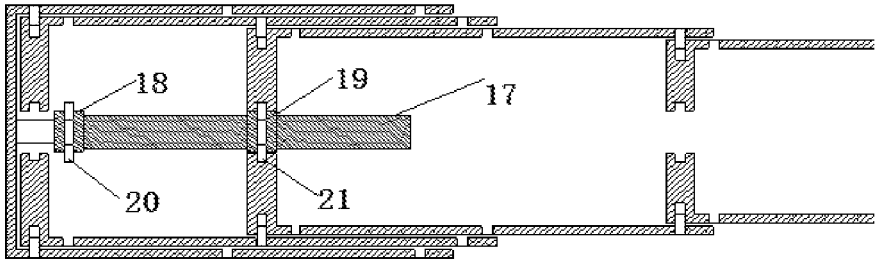
Figure 3K:
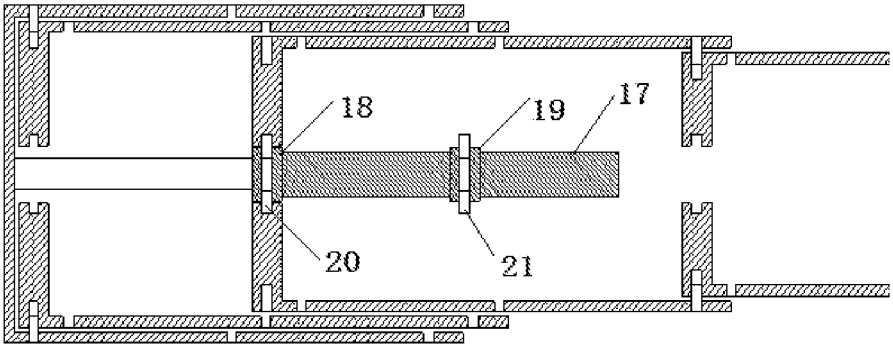
Figure 3L:
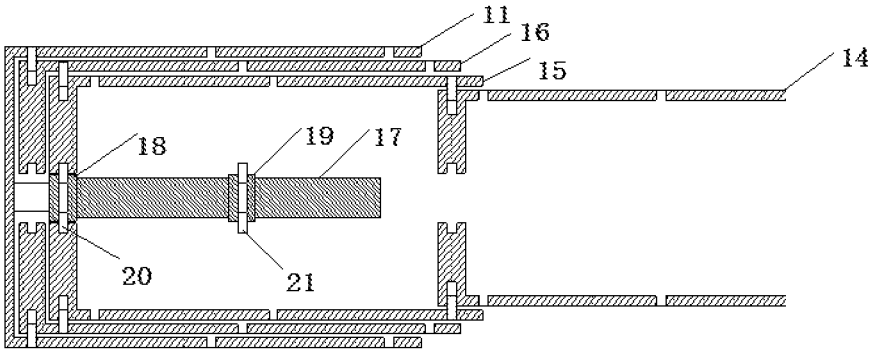
Figure 3M:
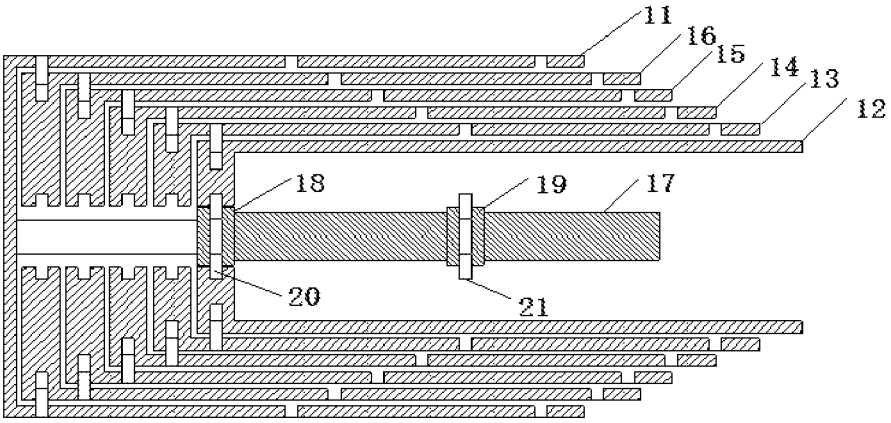

As shown in FIG. 2*a*, a single-cylinder plug pin type telescopic arm includes a basic arm 11 and five telescopic arms sleeved in the basic arm 11, wherein the five telescopic arms are respectively the last telescopic arm 12, the second-to-last telescopic arm 13, the third-to-last telescopic arm 14, the fourth-to-last telescopic arm 15 and the fifth-to-last telescopic arm 16, coaxial center holes are formed in the tails of the five telescopic arms, and a telescopic oil cylinder is arranged in the center holes; the telescopic oil cylinder includes a cylinder rod and a cylinder barrel 17, the cylinder rod is connected to a root hinge point of the basic arm, two cylinder heads are fixedly sleeved on the outer side of the cylinder barrel 17 in the longitudinal direction, the two cylinder heads are respectively a first cylinder head 18 and a second cylinder head 19, telescopic first cylinder pins 20 are arranged on left and right sides of the first cylinder head 18, telescopic second cylinder pins 21 are arranged on left and right sides of the second cylinder head 19, cylinder pin holes 22 are formed in the inner peripheral walls of the center holes at the tails 27 of the telescopic arms, and the cylinder barrel 17 can be selectively and fixedly connected with any telescopic arm by means of the cooperation of the cylinder pins and the cylinder pin holes; and three arm pin holes are formed in each of the basic arm and the telescopic arms in the longitudinal direction, the three arm pin holes are respectively a first arm pin hole 23, a second arm pin hole 24 and a third arm pin hole 25, telescopic arm pins 26 are arranged on the outer peripheral walls of the telescopic arms, and the basic arm and the first telescopic arm and adjacent telescopic arms can be locked or released through the cooperation of the arm pins and the arm pin holes.

The fixed end of the telescopic oil cylinder is connected to the root hinge point of the basic arm, and the movable end thereof can be selectively and fixedly connected with any telescopic arm through the cylinder pins. The cylinder rod is the fixed end of the telescopic oil cylinder, and the cylinder barrel is the movable end thereof.

The cylinder pins are generally at an extension state, namely in a state of locking the cylinder barrel with a certain telescopic arm; when needing to unlock, the cylinder pins can be propelled by a cylinder pin oil cylinder (not shown in the figure) to retract so as to unlock the cylinder barrel with a certain telescopic arm. When needing to lock the cylinder pins with a certain telescopic arm again, a pressure relief operation can be performed on the cylinder pin oil cylinder, and this time, the cylinder pins can extend out again.

First cylinder pin mounting holes (not shown in the figure) are formed on both sides of the first cylinder head 18, the first cylinder pins 20 are mounted in the first cylinder pin mounting holes; and second cylinder pin mounting holes (not shown in the figure) are formed on both sides of the second cylinder head 19, and the second cylinder pins 21 are mounted in the second cylinder pin mounting holes.

The arm pins 26 are driven by two first arm pin oil cylinders (not shown in the figure) or two second arm pin oil cylinders (not shown in the figure), the first arm pin oil cylinders are arranged in first arm pin oil cylinder mounting holes (not shown in the figure) of the first cylinder head 18, and the first arm pin oil cylinders are respectively located on both sides of the first cylinder head 18; and the second arm pin oil cylinders are arranged in second arm pin oil cylinder mounting holes (not shown in the figure) of the second cylinder head 19, and the second arm pin oil cylinders are respectively located on both sides of the second cylinder head 19.

The arm pins are generally arranged at the tops of the telescopic arms and can vertically move to lock or unlock the basic arm with the first telescopic arm and the adjacent telescopic arms. The bottom ends of the arm pins can be clamped in a dovetail groove, so that the arm pins can be driven by the dovetail groove to move in a substantially vertical direction; and the dovetail groove is fixedly connected with the arm pin oil cylinders to synchronously move with the arm pin oil cylinders.

The arm pin oil cylinders are arranged in the arm pin oil cylinder mounting holes of the cylinder heads, the lower ends thereof are fixedly connected with the cylinder heads, and the upper ends thereof are fixedly connected with the dovetail groove. The cylinder heads can extend out or retract with the cylinder barrel, so that the arm pin oil cylinders and the dovetail groove can move in the inner cavities of the telescopic arms along the axial direction; when at different positions, the dovetail groove can be clamped with different arm pins so as to drive different arm pins to extend out or retract.

Both of the first cylinder head 18 and the second cylinder head 19 are rectangular parallelepipeds, a central mounting hole running through each cylinder head is formed in the middle thereof, and the inside diameter of the central mounting hole is equal to the outside diameter of the cylinder barrel 17 to enable the cylinder barrel 17 to pass through the central mounting hole. The first cylinder head 18 and the second cylinder head 19 are fixed on the outer side of the cylinder barrel 17 in a conventional manner (for example, by bolts).

Figure 4:
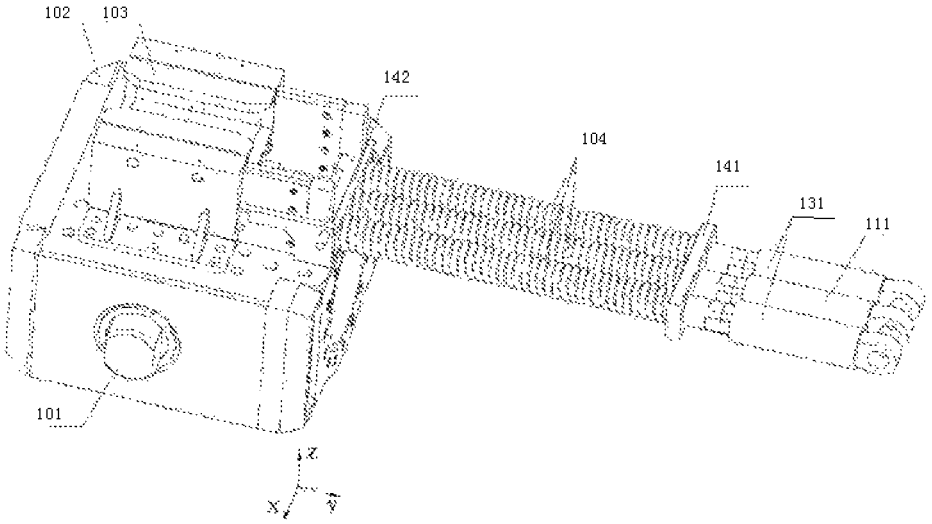
FIG. 4 is a schematic diagram of a shaft side of a single-cylinder plug pin mechanism in a specific implementation.
Figure 5:
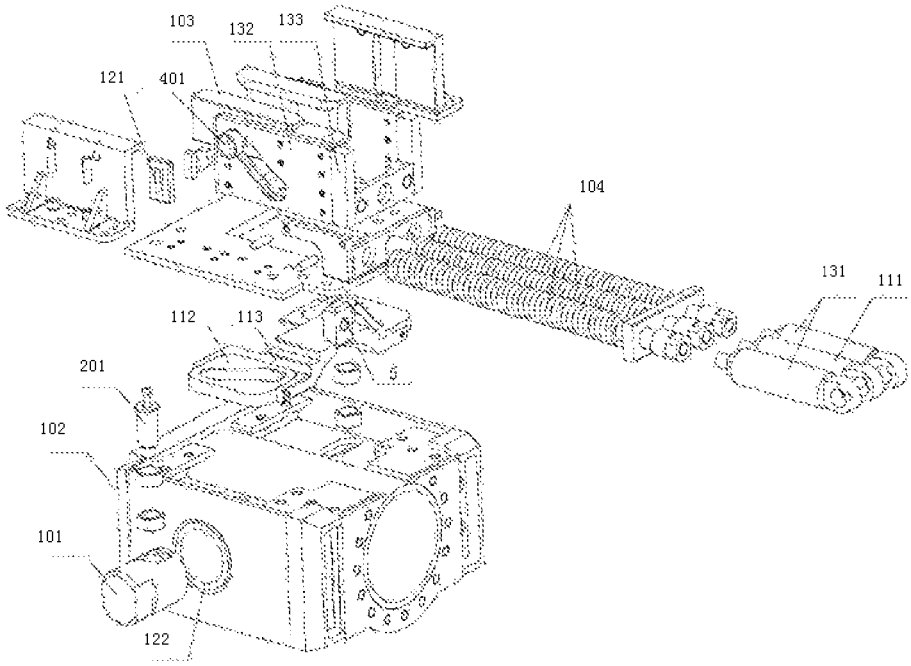
FIG. 5 is an assembly explosive view of the single-cylinder plug pin mechanism in FIG. 4.

In one embodiment, a single-cylinder plug pin mechanism for the telescopic arms is provided, to avoid a movement clamping stagnation phenomenon of the dovetail groove, and meanwhile relevant requirements on the acting force and the service life of a reset spring can be ensured to reduce the manufacturing cost. As shown in FIG. 4 and FIG. 5, wherein FIG. 4 is a schematic diagram of a shaft side of the single-cylinder plug pin mechanism in the implementation, and FIG. 5 is an assembly explosive view of the single-cylinder plug pin mechanism in FIG. 4.

A cylinder pin 101 of the single-cylinder plug pin mechanism is adopted to achieve cooperation of the oil cylinder and arm segments, and the cylinder pin 101 can extend out or retract relatively to a cylinder head body 102 along a first direction X; an arm pin (not shown in the figure) inserted in the dovetail groove 103 is adopted to achieve the cooperation of adjacent arm segments, and the dovetail groove 103 can extend out or retract relatively to the cylinder head body 102 along a second direction Z. Wherein, the first direction X is vertical to the second direction Z, specific locking linkage cooperation relation and working principle are the same as those in the prior art, and will not be repeated redundantly herein.

A cylinder pin oil cylinder 111 providing a driving force to the cylinder pin 101 and an arm pin oil cylinder 131 providing a driving force to the dovetail groove 103 (synchronously moving with the arm pin) are arranged on the same side of the cylinder head body 102 along a third direction Y, wherein the third direction Y is vertical to the first direction X and the second direction Z, and the third direction Y is consistent with the telescopic direction of the arm segments herein. Specifically, the cylinder pin oil cylinder 111 and the arm pin oil cylinder 131 respectively change the direction of the driving force through a cylinder pin driving slide block 112 and an arm pin driving slide block 132.

Wherein, the cylinder pin driving slide block 112 is connected with the movable end of the cylinder pin oil cylinder 111, a first inclined plane sliding fit pair is arranged between the cylinder pin driving slide block 112 and the cylinder pin 101, and can relatively slide in a plane formed by the first direction X and the third direction Y, a first direction sliding fit pair is arranged between the cylinder pin 101 and a punch hole of the cylinder head body 102, so that the cylinder pin 101 can be driven to extend out or retract through the driving force of the cylinder pin oil cylinder 111 and changing the direction of the driving force for 90 degrees. Wherein, the arm pin driving slide block 132 is connected with the movable end of the arm pin oil cylinder 131, a second inclined plane sliding fit pair is arranged between the arm pin driving slide block 132 and the dovetail groove 103, the second inclined plane sliding fit pair can relatively slide in a plane formed by the second direction Z and the third direction Y, and a second direction sliding fit pair is arranged between the dovetail groove 103 and the cylinder head body 102, so that the dovetail groove 103 can be driven to extend out or retract through the driving force of the arm pin oil cylinder 131 and changing the direction of the driving force for 90 degrees similarly. Meanwhile, the oil cylinders only bear axial pressures and bear no torque, therefore the load environment is better, the reliability of the oil cylinders is improved, and oil leakage is reduced. Actually, the first direction sliding fit pair and the second direction sliding fit pair can adopt different structural forms, as long as the first direction sliding fit pair and the second direction sliding fit pair can cooperate with corresponding inclined plane sliding fit pairs to limit the degrees of freedom of displacement in two directions and to change the direction of the acting force, for example, the first direction sliding fit pair is formed between a mounting hole 122 on the cylinder head body 102 and the cylinder pin 101, and the second direction sliding fit pair is formed between a guide block 121 which is provided on a second pin 401 on the dovetail groove 103 and a vertical guide groove 123 which is fixedly arranged on the cylinder head body 102.

It should be understood that, the two cooperation pairs can be achieved by adopting different structural forms, and the structural forms which as long as can change the direction of the driving force in the above-mentioned manner are encompassed within the scope of protection of the present application. The solution provides a preferred structure.

Figure 6:
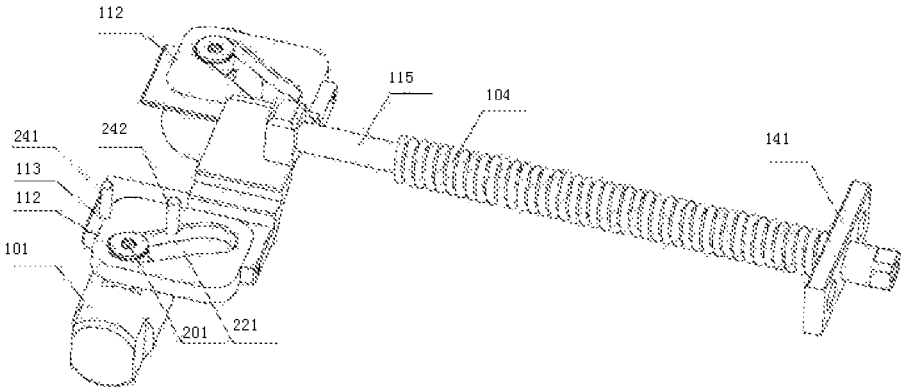
FIG. 6 is a schematic diagram of a cooperation state of a cylinder pin and a cylinder pin driving slide block as shown in FIG. 4.
Figure 7:
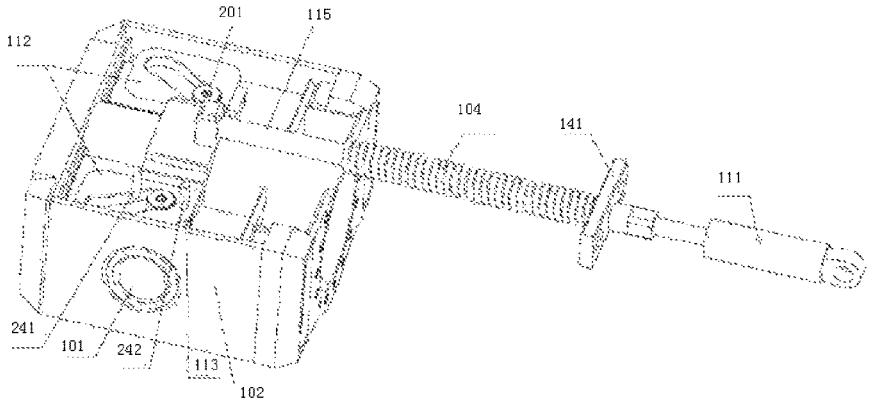
FIG. 7 is a schematic diagram of an assembly relation of the cylinder pin at a retraction state in the specific implementation.

Further, in combination with FIG. 6, the figure is a schematic diagram of a cooperation state of a cylinder pin and a cylinder pin driving slide block as shown in FIG. 4, and at the cooperation state, the cylinder pin is at the extension state. A first pin 201 formed by extending along the second direction Z is arranged on the cylinder pin 101 shown in the figure, correspondingly, an obliquely arranged first chute 221 is formed on the cylinder pin driving slide block 112, and the first pin 201 is inserted in the first chute 221 to form the first inclined plane sliding fit pair. Under a retraction driving force, the cylinder pin driving slide block 112 moves rightwards, based on the limitation of the cylinder head body 102 on the degrees of freedom of linear displacement of the cylinder pin 101 in the second direction Z and the third direction Y, the chute wall of the first chute 221 drives the first pin 201 and the cylinder pin 101 to retract, and the assembly relation of the cylinder pin at the retraction state is as shown in FIG. 7; and on the contrary, under an extension driving force, the cylinder pin driving slide block 112 moves leftwards, and the chute wall of the first chute 221 drives the first pin 201 and the cylinder pin 101 to extend out.

Figure 8:
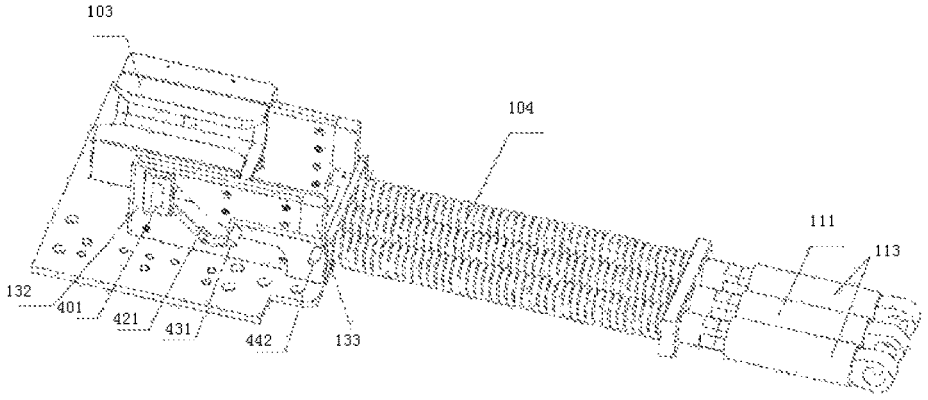
FIG. 8 is a schematic diagram of a cooperation state of a dovetail groove and an arm pin driving slide block as shown in FIG. 4.
Figure 9:
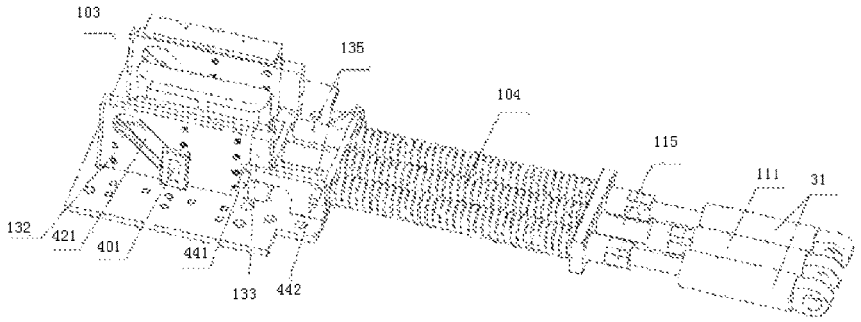
FIG. 9 is a schematic diagram of an assembly relation of the dovetail groove at the retraction state in the specific implementation.

In combination with FIG. 8, the figure is a schematic diagram of a cooperation state of the dovetail groove and the arm pin driving slide block as shown in FIG. 4, and at the cooperation state, the arm pin is at the extension state. A second pin 401 formed by extending along the first direction X is arranged on the dovetail groove 103 shown in the figure, correspondingly, an obliquely arranged second chute 421 is formed on the arm pin driving slide block 132, and the second pin 401 is inserted in the second chute 421 to form the second inclined plane sliding fit pair. Under the retraction driving force, the arm pin driving slide block 132 moves rightwards, based on the limitation of the cylinder head body 102 on the degrees of freedom of the linear displacement of the dovetail groove 103 in the first direction X and the third direction Y, the chute wall of the second chute 421 drives the second pin 401 and the dovetail groove 103 to retract, and the assembly relation of the dovetail groove at the retraction state is as shown in FIG. 9; and on the contrary, under the extension driving force, the arm pin driving slide block 132 moves leftwards, and the chute wall of the second chute 421 drives the second pin 401, the dovetail groove 103 and the arm pins to extend out.

Figure 10:
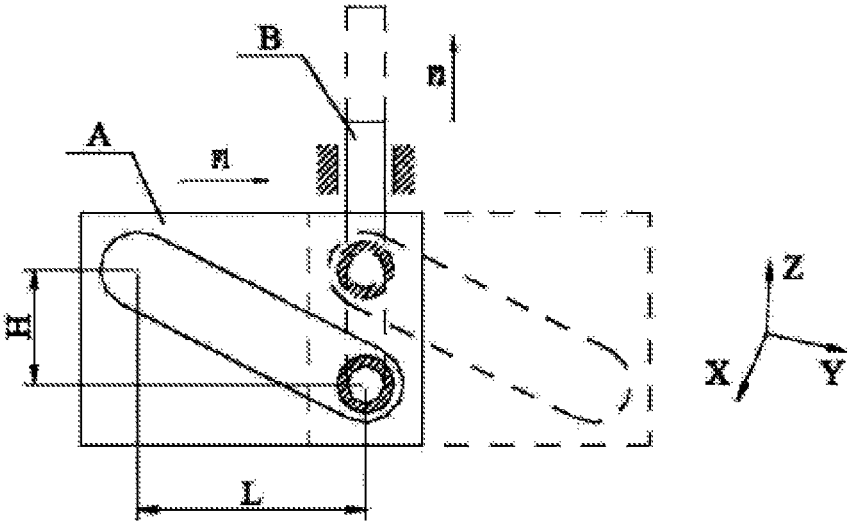
FIG. 10 is a schematic diagram of an inclined plane reinforcement working principle.

A brief illustration will be given below in combination with an inclined plane reinforcement working principle. As shown in FIG. 10, a mark A expresses a driving slide block with a chute, and a mark B expresses a driven device. Wherein: F2=F1(L/H); and F2 is in direct proportion to F1 and L, in view of this, when the size L is greater than H, a reinforcement effect can be obtained. That is to say, the displacement distance of the first inclined plane sliding fit pair along the third direction Y is greater than the displacement distance of the same along the first direction X; and the displacement distance of the second inclined plane sliding fit pair along the third direction Y is greater than the displacement distance of the same along the second direction Z, so that the requirements of a mounting space and a reinforcement function can be effectively compromised.

To effectively improve the acting performance of two cylinder pins 101 and the dovetail groove 103, two cylinder pin driving slide blocks 112 are arranged and are symmetrically arranged on both sides of the dovetail groove 103 respectively; and the two cylinder pin driving slide blocks 112 are connected together by a first bracket 113. Similarly, two arm pin driving slide blocks 132 are arranged and are symmetrically arranged on both sides of the dovetail groove 103 respectively; and the two arm pin driving slide blocks 132 are connected together by a second bracket 133.

In one embodiment, both of the cylinder pin driving slide block 112 and the arm pin driving slide block 132 can be made of a non-metal material, for example, nylon, to facilitate the guide cooperation of the corresponding chutes and the pins. Meanwhile, both of the first bracket 113 and the second bracket 133 are made of a metal material to meet the requirement of accurately detecting the working positions of the cylinder pins and arm pins; that is, synchronously moving metal brackets are taken as collection objects of proximity switches in the solution, specifically, a group of proximity switches is arranged to correspond to the first bracket 113 and another group to the second bracket 133, and only two proximity switches are adopted in each group to detect the motion precision; and since the number of the proximity switches is decreased, the cost is reduced.

As shown in FIG. 6 and FIG. 7, corresponding to the first bracket 113, a first proximity switch 241 and a second proximity switch 242 form a group and are configured as follows: when the cylinder pin driving slide block 112 is at the extension state as shown in FIG. 6, the first bracket 113 is located in a detection region of the first proximity switch 241, and accordingly the cylinder pin 101 is determined to be located at an extension working position; and when the cylinder pin driving slide block 112 is at the retraction state as shown in FIG. 7, the first bracket 113 is located in the detection region of the second proximity switch 141, and accordingly the cylinder pin 101 is determined to be located at a retraction working position.

As shown in FIG. 8 and FIG. 9, corresponding to the second bracket 133, a third proximity switch 441 and a fourth proximity switch 442 form a group and are configured as follows: when the arm pin driving slide block 132 is at the extension state as shown in FIG. 8, the second bracket 133 is located in the detection region of the third proximity switch 441, and accordingly the arm pin is determined to be located at the extension working position; and when the arm pin driving slide block 132 is at the retraction state as shown in FIG. 9, the second bracket 133 is located in the detection region of the fourth proximity switch 442, and accordingly the arm pin is determined to be located at the retraction working position.

It should be noted that, the driving force acting on the cylinder pin 101 and the dovetail groove 103 can be provided by a double-acting oil cylinder, as no reset spring is arranged, the structural design is relatively simple, and actually, the spring can also be arranged to play an auxiliary reset function. Of course, the driving force can also be provided by the cooperation of a single-acting oil cylinder and the reset spring, in such design, the reset spring can be adopted to achieve timely response and resetting the cylinder pins and the arm pins, so as to avoid the response time delay caused by oil way control.

In the solution, both of the cylinder pin oil cylinder 111 and the arm pin oil cylinder 131 are single-acting cylinders for providing corresponding retraction acting forces; the movable end of the cylinder pin oil cylinder 111 is connected with the cylinder pin driving slide block 112 through a cylinder pin connecting rod 115, and the movable end of the arm pin oil cylinder 131 is connected with the arm pin driving slide block 132 through an arm pin connecting rod 135; and compression springs 104 is arranged between a movable baffle 141 and a fixed baffle 142 to serve as an elastic component, and both of the cylinder pin connecting rod 115 and the arm pin connecting rod 135 are inserted in the movable baffle 141 and the fixed baffle 142. The compression springs 104 deform in a retraction process of the oil cylinders and store elastic deformation energy, so as to provide corresponding extension acting forces. Obviously, the compression springs 104 are the common elastic components to reset the cylinder pins and the arm pins.

It should be understood that, the numbers of the arm pin oil cylinder 131 and the cylinder pin oil cylinder 111 can be set according to actual product design requirements, as long as the driving force can be provided reliably. As shown in the figure, one cylinder pin oil cylinder 111 and one cylinder pin connecting rod 115 are arranged, and two arm pin oil cylinders 131 and two arm pin connecting rods 135 are symmetrically arranged relatively to the cylinder pin oil cylinder 111, and three compression springs 104 are respectively sleeved on the arm pin connecting rods 135 and the cylinder pin connecting rod 115. The cylinder pin oil cylinder 111 and the two arm pin oil cylinders 131 are arranged sequentially along the first direction X. Obviously, the cylinder pin oil cylinder 111, the arm pin oil cylinders 131 and the compression springs 104 are arranged on one side of the cylinder head body 102, so that arrangement spaces of corresponding members are increased, the sizes of the spring and the oil cylinders can be fully increased, and the plugging and pulling reliability of the cylinder pins and arm pins is improved to provide reliable guarantee for meeting the requirements of corresponding acting forces and the service lives of the members. In addition, driving oil cylinders are arranged on the side of the cylinder head body 102, so that designed nonstandard oil cylinder on the original cylinder head body can be replaced by a common standard oil cylinder without being limited by space.

Figure 11:
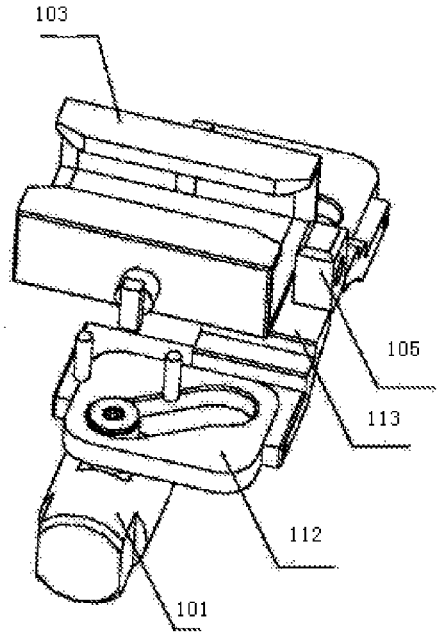
FIG. 11, FIG. 12, FIG. 13 and FIG. 14 respectively show schematic diagrams of a working relation of the interlocking block in the specific implementation.
Figure 12:
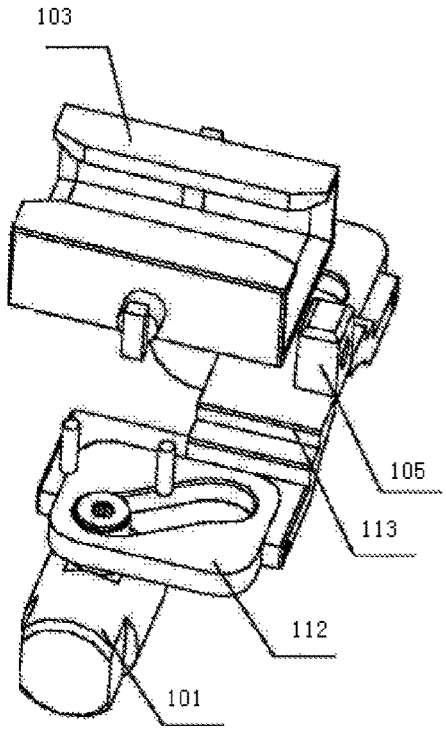
Figure 13:
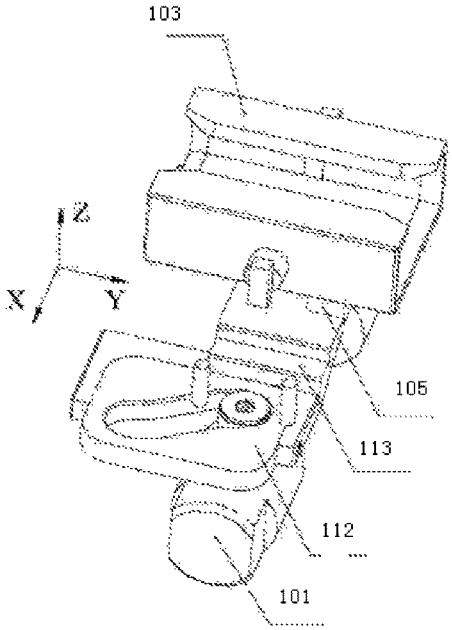
Figure 14:
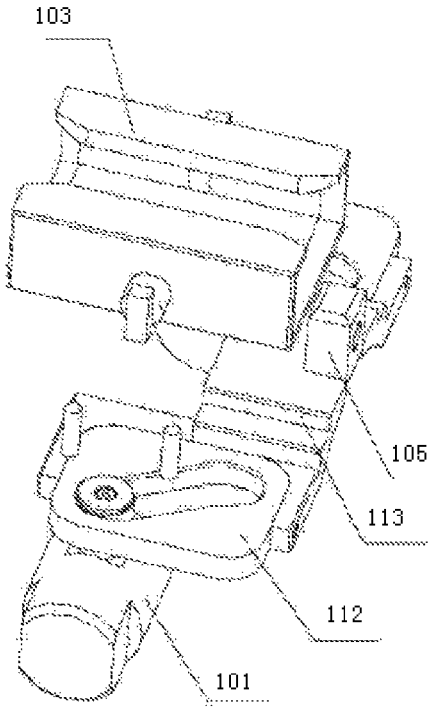

In addition, reliable mechanical interlock between the cylinder pins and the arm pins can also be established to prevent that the drop of the dovetail groove 103 and the retraction of the cylinder pin 101 happen at the same time. As shown in FIG. 11 to FIG. 14, an interlocking block 105 is arranged on the first bracket 113 and synchronously moves with the cylinder pin driving slide block 112. The interlocking block 105 is configured as follows: the dovetail groove 103 at the retraction state abuts against the interlocking block 105 along the third direction Y to limit the cylinder pin driving slide block 112 from driving the cylinder pin 101 to retract, as shown in FIG. 11, namely, after the dovetail groove 103 drops off, the cylinder pin is guaranteed to not retract; and when the dovetail groove 103 extends out, the interlocking block 105 releases the retraction limit on the cylinder pin driving slide block 112, as shown in FIG. 12. The interlocking block 105 at the retraction state abuts against the dovetail groove 103 along the second direction Z to limit the arm pin driving slide block 132 from driving the dovetail groove 103 to retract, as shown in FIG. 13, similarly, after the cylinder pin 101 retracts, the dovetail groove 103 is guaranteed to not drop off; and when the cylinder pin 101 extends out, the interlocking block 105 releases the retraction limit on the dovetail groove 103 and the arm pins, as shown in FIG. 14. Because of this arrangement, the structure is simple and reliable, a locking gap between the interlocking block 105 and the dovetail groove 103 can be directly measured by a vernier caliper, and thus the measurement is easier and the operability is better.

In addition, the cylinder head body 102 in the solution can adopt a box body welding manner to reduce the weight of the cylinder head body, and meanwhile, since the procedures and the precision requirements of the cylinder head body are reduced, the manufacturing cost can be further lowered.

In one embodiment, on this basis, an oil cylinder for a telescopic arm device is further provided, including a single-cylinder plug pin mechanism arranged at the cylinder head, wherein the single-cylinder plug pin mechanism adopts the foregoing single-cylinder plug pin mechanism. The main body structure of the oil cylinder can be implemented by the prior art, and will not be repeated redundantly herein.

Besides the foregoing single-cylinder plug pin mechanism and the oil cylinder, the implementation further provides a crane. The crane includes a telescopic arm device and a telescopic oil cylinder driving a telescopic arm for a telescopic operation, the foregoing single-cylinder plug pin mechanism is arranged at the cylinder head of the telescopic oil cylinder to switch operations between the oil cylinder and arm segments and between the arm segments. Similarly, it needs to be noted that, such other functional components of the crane as a chassis, an electric system, a hoisting system, a power system and the like can be implemented by the prior art, and will not be repeated redundantly herein.

The single-cylinder plug pin mechanism provided by the present invention effectively utilizes the inclined plane reinforcement working principle to respectively change the motions of corresponding driving oil cylinders for 90 degrees to drive the plug-in and pull-out of the cylinder pins and the arm pins. Specifically, both of the cylinder pin oil cylinder and the arm pin oil cylinder are arranged on the same side of the cylinder head body along the third direction, and herein the third direction is vertical to the first direction for plugging and pulling the cylinder pins and the second direction for plugging and pulling the arm pins; and the directions of the driving forces are respectively changed by the cylinder pin driving slide block and the arm pin driving slide block. Wherein, the first inclined plane sliding fit pair is arranged between the cylinder pin driving slide block connected with the cylinder pin oil cylinder and the cylinder pins, the first inclined plane sliding fit pair can relatively slide in the plane formed by the first direction and the third direction, and the first direction sliding fit pair is arranged between the cylinder pins and the cylinder head body, to drive the cylinder pins to extend out or retract through the cylinder pin oil cylinder so as to convert the third direction into the first direction; wherein the second inclined plane sliding fit pair is arranged between the arm pin driving slide block connected with the arm pin oil cylinder and the dovetail groove, the second inclined plane sliding fit pair can relatively slide in the plane formed by the second direction and the third direction, and the second direction sliding fit pair is arranged between the dovetail groove and the cylinder head body, to drive the dovetail groove to extend out or retract through the arm pin oil cylinder so as to convert the third direction into the second direction.

Due to this arrangement, on one hand, the arm pin oil cylinder drives the dovetail groove to move through a dovetail groove driving slide block, in order to completely avoid the movement clamping stagnation phenomenon of the dovetail groove caused by desynchrony of the arm pin oil cylinder; further, with respect to the change of the motion direction, both of the cylinder pin oil cylinder and the arm pin oil cylinder are arranged on the same side of the cylinder head body along the third direction, so that arrangement spaces of corresponding members can be increased, a reliable guarantee is provided for meeting the requirements of corresponding acting forces and the service lives of the members on the basis of improving the utilization rate of the internal space of the last telescopic arm, meanwhile, the oil cylinders have better load environments, only bear axial pressure and bear no torque, and thus the reliability of the oil cylinders is improved, and oil leakage is reduced. In addition, the driving oil cylinders are arranged on the side of the cylinder head body, and designed nonstandard oil cylinder on the original cylinder head body can be replaced by a common standard oil cylinder, therefore the manufacturing cost is effectively controlled.

In a preferred solution of the present invention, mechanical interlock between actions of the cylinder pins and the arm pins is achieved by an interlocking block which synchronously moves with the cylinder pin driving slide block. The interlocking block is specifically configured as follows: the dovetail groove at the retraction state abuts against the interlocking block along the third direction to limit the cylinder pin driving slide block from driving the cylinder pins to retract; and the interlocking block at the retraction state abuts against the dovetail groove along the second direction to limit the arm pin driving slide block from driving the dovetail groove to retract. Because of this arrangement, the structure is simple and reliable, a locking gap between the interlocking block and the dovetail groove can be directly measured by a vernier caliper, and thus the measurement is easier and the operability is better.

In another preferred solution of the present invention, both of the cylinder pin driving slide block and the arm pin driving slide block are made of a non-metal material, and correspondingly, the first bracket and the second bracket are made of a metal material; two groups of proximity switches correspond to the first bracket and the second bracket respectively, each group of proximity switches is provided with two proximity switches and is configured as follows: when the slide blocks are at an extension state, and the corresponding bracket is located in a detection region of one proximity switch; and when the slide blocks are at the retraction state, and the corresponding bracket is located in the detection region of the other proximity switch. Compared with the prior art, the number of the proximity switches is decreased, so that the manufacturing cost can be further controlled.

The present invention provides a crane, including the aforementioned single-cylinder plug pin type telescopic arm. Other portions of the crane can refer to the prior art, and will not be described in the present invention again.

The present invention further provides a telescopic method of the aforementioned single-cylinder plug pin type telescopic arm. Extension and retraction of each telescopic arm are carried out in two segments, the first cylinder head 18 is responsible for the extension of the former segment of the telescopic arm, the second cylinder head 19 is responsible for the extension of the latter segment of the telescopic arm, and the extension sequence is as follows: the last telescopic arm, the second-to-last telescopic arm, the third-to-last telescopic arm, the fourth-to-last telescopic arm and the fifth-to-last telescopic arm.

As shown in FIG. 2*a* to FIG. 2*k*, the extension method is as follows: the cylinder pins of the cylinder heads are retracted, the cylinder barrel 17 is moved, and when the first cylinder pins 20 of the first cylinder head 18 of the cylinder barrel 17 arrive at the positions of the cylinder pin holes of the last telescopic arm 12, the first cylinder pins 20 of the first cylinder head 18 are inserted into the cylinder pin holes of the last telescopic arm 12 to lock the cylinder barrel 17 with the last telescopic arm 12.

The arm pins of the last telescopic arm 12 are pulled down to release the last telescopic arm 12 and the second-to-last telescopic arm 13.

The cylinder barrel 17 brings out the last telescopic arm 12, and when the arm pins of the last telescopic arm 12 arrive at the position of the second arm pin hole of the second-to-last telescopic arm 13, the arm pins of the last telescopic arm 12 are inserted into the second arm pin hole of the second-to-last telescopic arm 13 to lock the last telescopic arm 12 and the second-to-last telescopic arm 13.

The cylinder pins of the cylinder heads are retracted, the cylinder barrel 17 is moved, and when the second cylinder pins 21 of the second cylinder head 19 of the cylinder barrel 17 arrive at the positions of the cylinder pin holes of the last telescopic arm 12, the second cylinder pins 21 of the second cylinder head 19 are inserted into the cylinder pin holes of the last telescopic arm 12 to lock the cylinder barrel 17 with the last telescopic arm 12.

The arm pins of the last telescopic arm 12 are pulled down to release the last telescopic arm 12 and the second-to-last telescopic arm 13.

The cylinder barrel 17 brings out the last telescopic arm 12, and when the arm pins of the last telescopic arm 12 arrive at the position of the third arm pin hole of the second-to-last telescopic arm 13, the arm pins of the last telescopic arm 12 are inserted into the third arm pin hole of the second-to-last telescopic arm 13 to lock the last telescopic arm 12 and the second-to-last telescopic arm 13 and completely extend out the last telescopic arm 12.

The cylinder pins of the cylinder heads are retracted, the cylinder barrel 17 is moved, and when the first cylinder pins 20 of the first cylinder head 18 of the cylinder barrel 17 arrive at the positions of the cylinder pin holes of the second-to-last telescopic arm 13, the first cylinder pins 20 of the first cylinder head 18 are inserted into the cylinder pin holes of the second-to-last telescopic arm 13 to lock the cylinder barrel 17 with the second-to-last telescopic arm 13.

The arm pins of the second-to-last telescopic arm 13 are pulled down to release the second-to-last telescopic arm 13 and the third-to-last telescopic arm 14.

The cylinder barrel 17 brings out the second-to-last telescopic arm 13, and when the arm pins of the second-to-last telescopic arm 13 arrive at the position of the second arm pin hole of the third-to-last telescopic arm 14, the arm pins of the second-to-last telescopic arm 13 are inserted into the second arm pin hole of the third-to-last telescopic arm 14 to lock the second-to-last telescopic arm 13 and the third-to-last telescopic arm 14.

The cylinder pins of the cylinder heads are retracted, the cylinder barrel 17 is moved, and when the second cylinder pins 21 of the second cylinder head 19 of the cylinder barrel 17 arrive at the positions of the cylinder pin holes of the second-to-last telescopic arm 13, the second cylinder pins 21 of the second cylinder head 19 are inserted into the cylinder pin holes of the second-to-last telescopic arm 13 to lock the cylinder barrel 17 with the second-to-last telescopic arm 13.

The arm pins of the second-to-last telescopic arm 13 are pulled down to release the second-to-last telescopic arm 13 and the third-to-last telescopic arm 14.

The cylinder barrel 17 brings out the second-to-last telescopic arm 13, and when the arm pins of the second-to-last telescopic arm 13 arrive at the position of the third arm pin hole of the third-to-last telescopic arm 14, the arm pins of the second-to-last telescopic arm 13 are inserted into the third arm pin hole of the third-to-last telescopic arm 14 to lock the second-to-last telescopic arm 13 and the third-to-last telescopic arm 14 and completely extend out the second-to-last telescopic arm 13.

The rest telescopic arms are sequentially extended out according to the extension steps of the last telescopic arm and the second-to-last telescopic arm to extend out all the telescopic arms.

The retraction operation is opposite to the extension operation in sequence, the first cylinder head 18 is responsible for the retraction of the former segment of the telescopic arm, the second cylinder head 19 is responsible for the retraction of the latter segment of the telescopic arm, and the retraction sequence is as follows: the first telescopic arm, the second telescopic arm, the third telescopic arm, the fourth telescopic arm and the fifth telescopic arm.

As shown in FIG. 3*a* to FIG. 3*m*, the retraction method is as follows: the cylinder pins of the cylinder heads are retracted, the cylinder barrel 17 is moved, and when the second cylinder pins 21 of the last cylinder head 19 of the cylinder barrel 17 arrive at the positions of the cylinder pin holes of the first telescopic arm 16, the second cylinder pins 21 of the last cylinder head 19 are inserted into the cylinder pin holes of the first telescopic arm 16 to lock the cylinder barrel 17 with the first telescopic arm 16.

The arm pins of the first telescopic arm 16 are pulled down to release a basic arm 11 and the first telescopic arm 16.

The cylinder barrel 17 brings back the first telescopic arm 16, and when the arm pins of the first telescopic arm 16 arrive at the position of the second-to-last arm pin hole 24 of the basic arm 11, the arm pins of the first telescopic arm 16 are inserted into the second-to-last arm pin hole 24 of the basic arm 11 to lock the basic arm 11 and the first telescopic arm 16.

The cylinder pins of the cylinder heads are retracted, the cylinder barrel 17 is moved, and when the first cylinder pins 20 of the second-to-last cylinder head 18 of the cylinder barrel 17 arrive at the positions of the cylinder pin holes of the first telescopic arm 16, the first cylinder pins 20 of the second-to-last cylinder head 18 are inserted into the cylinder pin holes of the first telescopic arm 16 to lock the cylinder barrel 17 with the first telescopic arm 16.

The arm pins of the first telescopic arm 16 are pulled down to release the basic arm 11 and the first telescopic arm 16.

The cylinder barrel 17 brings back the first telescopic arm 16, and when the arm pins of the first telescopic arm 16 arrive at the position of the third-to-last arm pin hole 23 of the basic arm 11, the arm pins of the first telescopic arm 16 are inserted into the third-to-last arm pin hole 23 of the basic arm 11 to lock the basic arm 11 and the first telescopic arm 16 and completely retract the first telescopic arm 16.

The cylinder pins of the cylinder heads are retracted, the cylinder barrel 17 is moved, and when the second cylinder pins 21 of the last cylinder head 19 of the cylinder barrel 17 arrive at the positions of the cylinder pin holes of the second telescopic arm 15, the second cylinder pins 21 of the last cylinder head 19 are inserted into the cylinder pin holes of the second telescopic arm 15 to lock the cylinder barrel 17 with the second telescopic arm 15.

The arm pins of the second telescopic arm 15 are pulled down to release the first telescopic arm 16 and the second telescopic arm 15.

The cylinder barrel 17 brings back the second telescopic arm 15, and when the arm pins of the second telescopic arm 15 arrive at the position of the second-to-last arm pin hole 24 of the first telescopic arm 16, the arm pins of the second telescopic arm 15 are inserted into the second-to-last arm pin hole 24 of the first telescopic arm 16 to lock the first telescopic arm 16 and the second telescopic arm 15.

The cylinder pins of the cylinder heads are retracted, the cylinder barrel 17 is moved, and when the first cylinder pins 20 of the second-to-last cylinder head 18 of the cylinder barrel 17 arrive at the positions of the cylinder pin holes of the second telescopic arm 15, the first cylinder pins 20 of the second-to-last cylinder head 18 are inserted into the cylinder pin holes of the second telescopic arm 15 to lock the cylinder barrel 17 with the second telescopic arm 15.

The arm pins of the second telescopic arm 15 are pulled down to release the first telescopic arm 16 and the second telescopic arm 15.

The cylinder barrel 17 brings back the second telescopic arm 15, and when the arm pins of the second telescopic arm 15 arrive at the position of the third-to-last arm pin hole 23 of the first telescopic arm 16, the arm pins of the second telescopic arm 15 are inserted into the third-to-last arm pin hole 23 of the first telescopic arm 16 to lock the first telescopic arm 16 and the second telescopic arm 15 and completely retract the second telescopic arm 15.

The rest telescopic arms are sequentially retracted according to the retraction steps of the first telescopic arm and the second telescopic arm to retract all the telescopic arms.

It needs to be noted that, at any moment, any telescopic arm is either locked with other telescopic arms through the arm pins or locked with the telescopic oil cylinder through the cylinder pins.

The cylinder pins of all the cylinder heads are linked to synchronously extend out or synchronously retract.

Since the cylinder pins are arranged on both sides of the cylinder heads, and at least two cylinder heads are arranged, a synchronous device can be arranged between the cylinder pins to link all the cylinder pins, so as to enable all the cylinder pins to synchronously extend out or synchronously retract. Of course, the linkage manner of all the cylinder pins is not limited to the synchronous device, and other prior arts capable of linking all the cylinder pins can be adopted.

Finally, it should be noted that the above embodiments are merely used for illustrating the technical solutions of the present invention, rather than limiting them; although the present invention has been described in detail with reference to preferred embodiments, those of ordinary skill in the art should understand that they could still make modifications to the specific implementations of the present invention or make equivalent substitutions to a part of technical features; and these modifications or substitutions shall fall into the scope of protection of the technical solutions of the present invention without departing from the spirit of the technical solutions of the present invention.

The invention claimed is:

1. A single-cylinder plug pin type telescopic arm, comprising:

a basic arm and at least one telescopic arm sleeved in the basic arm, wherein coaxial center holes are formed in tails of the at least one telescopic arm, and a telescopic oil cylinder is arranged in the center holes;

the telescopic oil cylinder comprises a cylinder rod and a cylinder barrel, the cylinder rod is connected to a root hinge point of the basic arm, at least two cylinder heads are fixedly sleeved on an outer side of the cylinder barrel in the longitudinal direction, telescopic cylinder pins are arranged on left and right sides of each cylinder head, cylinder pin holes are formed in inner peripheral walls of the center holes at tails of the at least one telescopic arm, and the cylinder barrel is adapted to be selectively and fixedly connected with any telescopic arm by means of the cooperation of the cylinder pins and the cylinder pin holes; and at least three arm pin holes are formed in each of the basic arm and the at least one telescopic arm in the longitudinal direction, the number of the arm pin holes of each arm is at least one more than that of the cylinder heads, telescopic arm pins are arranged on outer peripheral walls of the at least one telescopic arm, and the basic arm, a first telescopic arm and adjacent telescopic arms are adapted to be locked or released through the cooperation of the arm pins and the arm pin holes;

wherein the single-cylinder plug pin type telescopic arm further comprises a single-cylinder plug pin mechanism; each of the at least two the cylinder heads comprises a cylinder head body, and the cylinder pins are adapted to extend out or retract relatively to the cylinder head body along a first direction; the single-cylinder plug pin mechanism comprises:

a dovetail groove extending out or retracting relatively to the cylinder head body along a second direction, a cylinder pin oil cylinder providing a driving force to the cylinder pins, and an arm pin oil cylinder providing a driving force to the dovetail groove; wherein the first direction is vertical to the second direction; the cylinder pin oil cylinder and the arm pin oil cylinder are arranged on the same side of the cylinder head body along a third direction, and the third direction is vertical to the first direction and the second direction.

2. The single-cylinder plug pin type telescopic arm of claim 1, wherein the number of the arm pin holes of each arm is one more than that of the cylinder heads.

3. The single-cylinder plug pin type telescopic arm of claim 1, wherein two cylinder heads are fixedly sleeved on the outer side of the cylinder barrel in the longitudinal direction, and three arm pin holes are formed in each of the basic arm and the at least one telescopic arm in the longitudinal direction.

4. The single-cylinder plug pin type telescopic arm of claim 1, wherein the single-cylinder plug pin mechanism further comprises: a cylinder pin driving slide block connected with the movable end of the cylinder pin oil cylinder, a first inclined plane sliding fit pair is arranged between the cylinder pin driving slide block and the cylinder pins, and is adapted to relatively slide in a plane formed by the first direction and the third direction, a first direction sliding fit pair is arranged between the cylinder pins and the cylinder head body, to drive the cylinder pins to extend out or retract through the cylinder pin oil cylinder; and an arm pin driving slide block connected with the movable end of the arm pin oil cylinder, a second inclined plane sliding fit pair is arranged between the arm pin driving slide block and the dovetail groove, and is adapted to relatively slide in a plane formed by the second direction and the third direction, and a second direction sliding fit pair is arranged between the dovetail groove and the cylinder head body, to drive the dovetail groove to extend out or retract through the arm pin oil cylinder.

5. The single-cylinder plug pin type telescopic arm of claim 4, wherein a first pin formed by extending along the second direction is arranged on the cylinder pin, a first chute is obliquely formed on the cylinder pin driving slide block, and the first pin is inserted in the first chute to form the first inclined plane sliding fit pair; a second pin formed by extending along the first direction is arranged on the dovetail groove, a second chute is obliquely formed on the arm pin driving slide block, and the second pin is inserted in the second chute to form the second inclined plane sliding fit pair; and the second direction sliding fit pair is formed between a guide block which is provided on the second pin on the dovetail groove and a vertical guide groove which is fixedly arranged on the cylinder head body.

6. The single-cylinder plug pin type telescopic arm of claim 5, wherein the single-cylinder plug pin mechanism further comprises an interlocking block which synchronously moves with the cylinder pin driving slide block, and the interlocking block is configured as follows: the dovetail groove at a retraction state abuts against the interlocking block along the third direction to limit the cylinder pin driving slide block from driving the cylinder pins to retract; and the interlocking block at the retraction state abuts against the dovetail groove along the second direction to limit the arm pin driving slide block from driving the dovetail groove to retract.

7. The single-cylinder plug pin type telescopic arm of claim 6, wherein two cylinder pins and two cylinder pin driving slide blocks are arranged and are symmetrically arranged on both sides of the dovetail groove respectively; the two cylinder pin driving slide blocks are connected together by a first bracket, and the interlocking block is fixedly arranged on the first bracket; two arm pin driving slide blocks are symmetrically arranged on both sides of the dovetail groove respectively; and the two arm pin driving slide blocks are connected together by a second bracket.

8. The single-cylinder plug pin type telescopic arm of claim 7, wherein both of the cylinder pin driving slide block and the arm pin driving slide block are made of a non-metal material, and both of the first bracket and the second bracket are made of a metal material; two groups of proximity switches correspond to the first bracket and the second bracket respectively, each group of proximity switches is provided with two proximity switches and is configured as follows: when the slide blocks are at an extension state, the corresponding bracket is located in a detection region of one proximity switch; and when the slide blocks are at the retraction state, the corresponding bracket is located in a detection region of the other proximity switch.

9. The single-cylinder plug pin type telescopic arm of claim 4, wherein both of the cylinder pin oil cylinder and the arm pin oil cylinder are single acting cylinders for providing corresponding retraction acting forces; a movable end of the cylinder pin oil cylinder is connected with the cylinder pin driving slide block through a cylinder pin connecting rod, and a movable end of the arm pin oil cylinder is connected with the arm pin driving slide block through an arm pin connecting rod; and both of the cylinder pin connecting rod and the arm pin connecting rod are inserted in a movable baffle and a fixed baffle, and an elastic component is arranged between the movable baffle and the fixed baffle to provide a corresponding extension acting force.

10. The single-cylinder plug pin type telescopic arm of claim 9, wherein the elastic component is specifically a compression spring sleeved on the cylinder pin connecting rod or the arm pin connecting rod; there are one cylinder pin oil cylinder and one cylinder pin connecting rod, and two arm pin oil cylinders and two arm pin connecting rods are symmetrically arranged relatively to the cylinder pin oil cylinder; and the cylinder pin oil cylinder and the two arm pin oil cylinders are arranged sequentially along the first direction.

11. The single-cylinder plug pin type telescopic arm of claim 4, wherein the displacement distance of the first inclined plane sliding fit pair along the third direction is greater than the displacement distance of the same along the first direction; and the displacement distance of the second inclined plane sliding fit pair along the third direction is greater than the displacement distance of the same along the second direction.

12. A crane comprising the single-cylinder plug pin type telescopic arm of claim 1.

13. A telescopic method of the single-cylinder plug pin type telescopic arm of claim 1, comprising:

retracting the cylinder pins of the cylinder heads, moving the cylinder barrel, and when the cylinder pins of the first cylinder head of the cylinder barrel arrive at the positions of the cylinder pin holes of the last telescopic arm, inserting the cylinder pins of a first cylinder head into the cylinder pin holes of a last telescopic arm to lock the cylinder barrel with the last telescopic arm; pulling down the arm pins of the last telescopic arm to release the last telescopic arm and a second-to-last telescopic arm; bringing out the last telescopic arm through the cylinder barrel, and when the arm pins of the last telescopic arm arrive at the position of a second arm pin hole of the second-to-last telescopic arm, inserting the arm pins of the last telescopic arm into the second arm pin hole of the second-to-last telescopic arm to lock the last telescopic arm and the second-to-last telescopic arm; sequentially performing the operation steps of the first cylinder head on rest cylinder heads of the cylinder barrel to completely extend out the last telescopic arm; and sequentially extending out rest telescopic arms according to the extension steps of the last telescopic arm to extend out all the at least one telescopic arm.

14. The telescopic method of claim 13, comprising: retracting the cylinder pins of the cylinder heads, moving the cylinder barrel, and when the cylinder pins of the last cylinder head of the cylinder barrel arrive at the positions of the cylinder pin holes of the first telescopic arm, inserting the cylinder pins of the last cylinder head into the cylinder pin holes of the first telescopic arm to lock the cylinder barrel with the first telescopic arm; pulling down the arm pins of the first telescopic arm to release the basic arm and the first telescopic arm; bringing back the first telescopic arm through the cylinder barrel, and when the arm pins of the first telescopic arm arrive at the position of the second-to-last arm pin hole of the basic arm, inserting the arm pins of the first telescopic arm into the second-to-last arm pin hole of the basic arm to lock a basic arm and the first telescopic arm; sequentially performing the operation steps of a last cylinder head on the rest cylinder heads of the cylinder barrel to completely retract the last telescopic arm; and sequentially retracting the rest telescopic arms according to the retraction steps of the first telescopic arm to retract all the at least one telescopic arm.

15. The telescopic method of claim 13, wherein the cylinder pins of all the cylinder heads are linked to synchronously extend out or synchronously retract.

* * * * *